US009399349B2

(12) United States Patent
Ohnishi

(10) Patent No.: US 9,399,349 B2
(45) Date of Patent: Jul. 26, 2016

(54) INK SUPPLY DEVICE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/443,068

(22) PCT Filed: Nov. 15, 2013

(86) PCT No.: PCT/JP2013/080853
§ 371 (c)(1),
(2) Date: May 14, 2015

(87) PCT Pub. No.: WO2014/077345
PCT Pub. Date: May 22, 2014

(65) Prior Publication Data

US 2015/0321480 A1 Nov. 12, 2015

(30) Foreign Application Priority Data

Nov. 17, 2012 (JP) ..... 2012-252778

(51) Int. Cl.
*B41J 2/175* (2006.01)

(52) U.S. Cl.
CPC ..... *B41J 2/17523* (2013.01); *B41J 2/17509* (2013.01); *B41J 2/17513* (2013.01); *B41J 2/17596* (2013.01)

(58) Field of Classification Search
CPC .. B41J 2/17513; B41J 2/1752; B41J 2/17523; B41J 2/17553; B41J 2/17556
USPC ..... 347/84–86
See application file for complete search history.

(56) References Cited

U.S. PATENT DOCUMENTS

2005/0088497 A1* 4/2005 Katayama ..... B41J 2/17509 347/86
2007/0030302 A1* 2/2007 Yamada ..... B41J 2/17523 347/31

(Continued)

FOREIGN PATENT DOCUMENTS

JP 2000-141687 5/2000
JP 2004-049598 2/2004

(Continued)

OTHER PUBLICATIONS

"International Search Report (Form PCT/ISA/210)", mailed on Feb. 10, 2014, with English translation thereof, pp. 1-4, in which four of the listed references (JP2005-161642A, JP2004-049598A, JP2000-141687A and JP2006-224529A) were cited.

*Primary Examiner* — Manish S Shah
*Assistant Examiner* — Roger W Pisha, II
(74) *Attorney, Agent, or Firm* — Belinda Lee

(57) ABSTRACT

An ink supply device is provided for supplying ink (10*c*) to a recording head for discharging the ink in an inkjet printer, that includes: a replaceable ink container (30) being a container for storing the ink (10*c*) and being replaceable; and a male connector (41) to be inserted into the replaceable ink container (30) to take out the ink (10*c*) from the replaceable ink container (30), wherein the replaceable ink container (30) includes an opening plug (31) that plugs an insertion opening (30*a*) where the male connector (41) is to be inserted, and the opening plug (31) includes a reed valve (32) that is pressed by the male connector (41) and opened when the male connector (41) is inserted into the insertion opening (30*a*), and that is closed by making contact with the male connector (41) when the male connector (41) is pulled out from the insertion opening (30*a*).

9 Claims, 24 Drawing Sheets

(56) References Cited

U.S. PATENT DOCUMENTS

2011/0221836 A1* 9/2011 Kobayashi ..... B41J 2/17509 347/85
2011/0254905 A1* 10/2011 Hayashi ..... B41J 2/175 347/86

FOREIGN PATENT DOCUMENTS

JP 2005-161642 6/2005
JP 2006-224529 8/2006
JP 2010-023237 2/2010

* cited by examiner

INK SUPPLY DEVICE

CROSS-REFERENCE TO RELATED APPLICATION

This application is a 371 application of an international PCT application serial no. PCT/JP2013/080853, filed on Nov. 15, 2013, which claims the priority benefit of Japan application no. JP 2012-252778, filed on Nov. 17, 2012. The entirety of each of the above-mentioned patent applications is hereby incorporated by reference herein and made a part of this specification.

TECHNICAL FIELD

The present invention relates to an ink supply device for supplying ink to a recording head from which the ink is to be discharged in an inkjet printer.

BACKGROUND ART

Conventionally, as an ink supply device for supplying ink to a recording head for discharging ink in an inkjet printer, one provided with a replaceable ink container that is a container for storing ink and that is replaceable, and a needle to be inserted into the replaceable ink container to take out the ink from the replaceable ink container is known (see Patent Document 1). This replaceable ink container is provided with an opening plug formed of an elastic member such as rubber for plugging an insertion opening to which the needle is to be inserted. With this opening plug being penetrated by the needle, the ink inside the replaceable ink container is taken out to the outside of the replaceable ink container through a passage provided in the needle.

In the meantime, in an inkjet printer with relatively large consumption amount of ink, that is, in a wide-format inkjet printer with a relatively large printable image size, or in an inkjet printer with relatively fast printing speed, capacities of replaceable ink containers are being increased.

PRIOR ART DOCUMENT

Patent Document

Patent Document 1: JP 2010-23237 A.

SUMMARY OF THE INVENTION

Problems to be Solved by the Invention

However, in a conventional ink supply device that is provided with a replaceable ink container including an opening plug made of an elastic member and a needle to be inserted into the opening plug, if the needle for taking out the ink inside the replaceable ink container to the outside of the replaceable ink container is thin, a passage provided in the needle becomes narrow accordingly, so that there is a problem that it becomes difficult to supply the ink at a large flow rate from the replaceable ink container. On the other hand, in the conventional ink supply device provided with the replaceable ink container including the opening plug made of the elastic member and the needle to be inserted into the opening plug, if the needle is to be made thick for supplying the ink at a large flow rate from the replaceable ink container, when the needle is pulled out from the replaceable ink container due to reasons such as changing the ink color and the like in a state where ink still remains in the replaceable ink container, there is a problem that the ink inside the replaceable ink container may possibly leak out to the outside of the replaceable ink container through a hole opened in the opening plug by the needle.

Since there is a problem as above, the conventional ink supply device provided with the replaceable ink container including the opening plug made of the elastic member and the needle to be inserted into the opening plug is not suited for making the replaceable ink container have a large capacity.

Thus, the present invention aims to provide an ink supply device that can reduce the possibility of the ink flowing out from the replaceable ink container when the male connector is pulled out from the replaceable ink container compared to in the conventional configuration.

Solutions to the Problem

An ink supply device of the present invention is an ink supply device for supplying an ink to a recording head for discharging the ink in an inkjet printer, and it includes: a replaceable ink container being a container for storing the ink and being replaceable; and a male connector to be inserted into the replaceable ink container to take out the ink from the replaceable ink container, wherein the replaceable ink container has an insertion opening where the male connector is to be inserted formed therein, the replaceable ink container includes an opening plug that plugs the insertion opening, and the opening plug includes a reed valve that is pressed by the male connector and opened when the male connector is inserted into the insertion opening, and that is closed by making contact with the male connector when the male connector is pulled out from the insertion opening.

According to this configuration, when the male connector is pulled out from the replaceable ink container, in the ink supply device of the present invention, the possibility that the ink will flow out from the replaceable ink container can be reduced compared to in the conventional configuration, since the reed valve closes automatically.

Further, in the ink supply device of the present invention, the reed valve may be a valve that is closed by receiving pressure of the ink when the male connector is pulled out from the insertion opening.

According to this configuration, the ink supply device of the present invention can improve certainty that the reed valve will close, since the closing force is applied to the reed valve by receiving the pressure of the ink when the male connector is pulled out from the replaceable ink container.

Further, in the ink supply device of the present invention, the reed valve may be a valve to which closing force is applied by rigidity of its valve body when the male connector is pulled out from the insertion opening.

According to this configuration, the ink supply device of the present invention can improve the certainty that the reed valve will close, since the closing force is applied to the reed valve by the rigidity of its valve body when the male connector is pulled out from the replaceable ink container.

Further, in the ink supply device of the present invention, the opening plug may further include a valve biasing unit that biases the reed valve in a direction along which the reed valve closes.

According to this configuration, the ink supply device of the present invention can improve the certainty that the reed valve will close, since the closing force is applied to the reed valve by the biasing force from the valve biasing unit when the male connector is pulled out from the replaceable ink container.

Further, in the ink supply device of the present invention, the replaceable ink container may include an ink bag of which capacity is capable of being changed according to an amount of the stored ink, and a bag biasing unit that biases the ink bag in a direction along which the capacity of the ink bag is decreased.

According to this configuration, since the ink supply device of the present invention can maintain the pressure of the ink inside the ink bag at positive pressure, the reed valve having received the pressure of the ink can be closed automatically when the male connector is pulled out from the replaceable ink container, even if a position of the opening plug is provided at a position other than below the ink bag. Further, with the ink supply device of the present invention, since the pressure of the ink inside the ink bag can be maintained at positive pressure, the ink inside the replaceable ink container can be taken out almost to the last drip via the male connector, even if the position of the opening plug is provided at a position other than below the ink bag.

Further, the ink supply device of the present invention may further include a pump that controls pressure of the ink so that the pressure of the ink becomes higher on an inside than on an outside of the replaceable ink container with respect to the insertion opening.

According to this configuration, since the ink supply device of the present invention can maintain the pressure of the ink higher on the inside than on the outside of the replaceable ink container with respect to the insertion opening, the ink inside the replaceable ink container can be taken out almost to the last drip via the male connector, even if the position of the opening plug is provided at a position other than below the ink bag.

Further, in the ink supply device of the present invention, a shape of the male connector in its cross section vertically intersecting a direction of insertion into the insertion opening may be an elongated shape.

According to this configuration, in the ink supply device of the present invention, force applied to both end portions of the reed valve in the direction vertically intersecting the direction of insertion of the male connector into the insertion opening upon the insertion of the male connector into the insertion opening is small, as compared to a configuration in which a shape of the male connector in its cross section vertically intersecting a direction of insertion of the male connector into an insertion opening is not in the elongated shape, so that the force required for inserting the male connector into the insertion opening can be reduced, and the life of the reed valve can be extended.

Further, in the ink supply device of the present invention, the male connector and the reed valve may be fitted with each other to a degree by which the ink does not leak out from between the male connector and the reed valve when the male connector has been inserted into the insertion opening.

According to this configuration, the ink supply device of the present invention can do away with members for preventing the ink from leaking out from between the male connector and the reed valve, such as an O-ring.

Further, in the ink supply device of the present invention, the opening plug may include an O-ring for preventing the ink from passing through, and the O-ring may be arranged at a position that prevents the ink from passing through between the male connector and the O-ring when the male connector that has been inserted into the insertion opening is keeping the reed valve opened.

According to this configuration, since the ink supply device of the present invention can prevent the ink from leaking out from between the male connector and the opening plug by the O-ring, even if the reed valve cannot deform in accordance with the shape of the male connector at a high accuracy which is at the degree by which no ink leaks out from between the male connector and the reed valve, a degree of freedom in design of the reed valve can be improved as compared to a configuration in which the reed valve deforms in accordance with the shape of the male connector at the high accuracy which is at the degree by which no ink leaks out from between the male connector and the reed valve.

Effects of the Invention

The ink supply device of the present invention can reduce the possibility that the ink will flow out from the replaceable ink container when the male connector is pulled out from the replaceable ink container compared to in the conventional configuration.

BRIEF DESCRIPTION OF THE DRAWINGS

FIG. 4 is a plan view of a reed valve of the replaceable ink container in a state shown in

FIG. 3.

EMBODIMENTS OF THE INVENTION

Hereinbelow, embodiments of the present invention will be described with reference to the drawings.

(First Embodiment)

Firstly, a configuration of an inkjet printer according to the present embodiment will be described.

Figure 1:
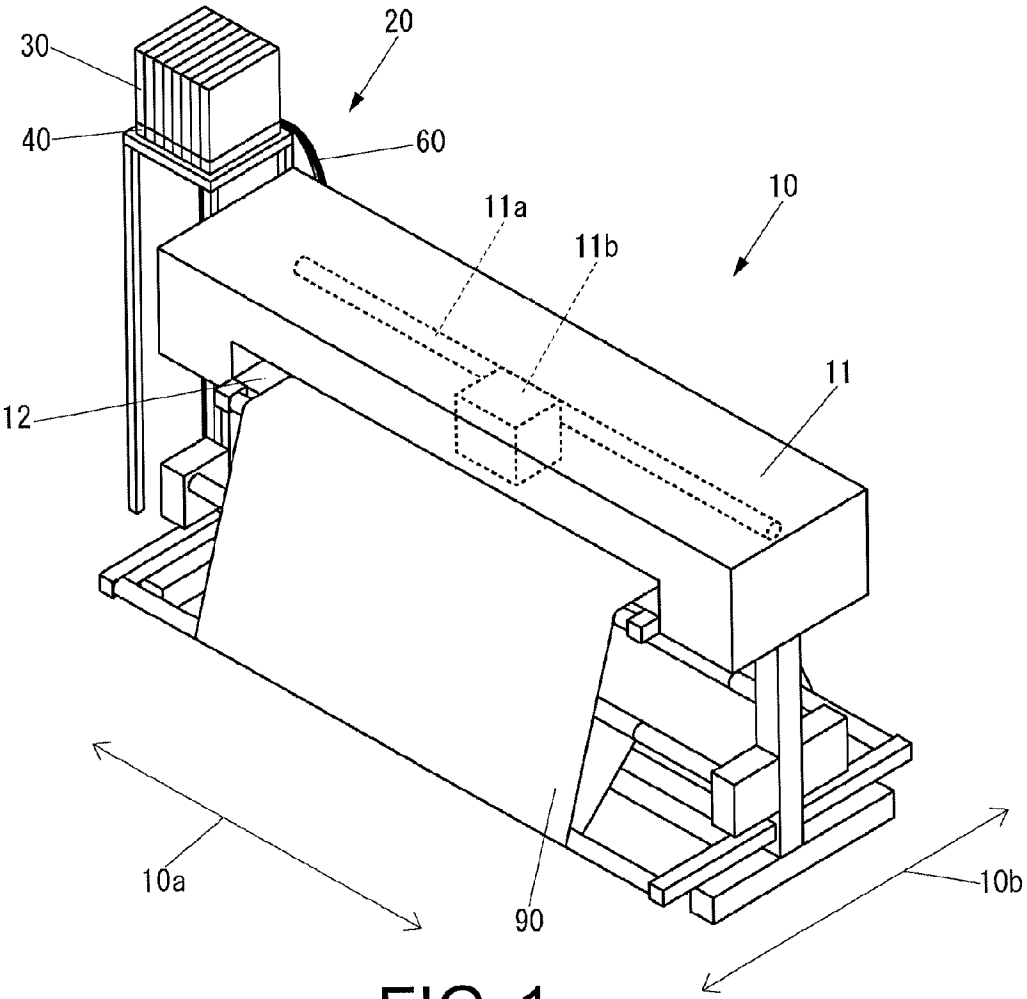
FIG. 1 is a perspective view of an inkjet printer according to a first embodiment of the present invention.

FIG. 1 is a perspective view of an inkjet printer 10 according to the present embodiment.

As shown in FIG. 1, an inkjet printer 10 includes a main body 11 extending in a main scanning direction shown by an arrow 10*a*, a transfer device 12 that transfers a recording medium 90 such as paper, and an ink supply device 20 for supplying ink to recording heads 11*c* described later that discharge the ink.

The main body 11 includes a guide rail 11*a* extending in the main scanning direction shown by the arrow 10*a*, and a carriage 11*b* supported on the guide rail 11*a* so as to be movable in the main scanning direction shown by the arrow 10*a*. The carriage 11*b* is mounted with recording heads 11*c*.

The transfer device 12 is a device that transfers the recording medium 90 in a sub scanning direction shown by an arrow 10*b* relative to the recording heads 11*c* of the main body 11.

Figure 2:
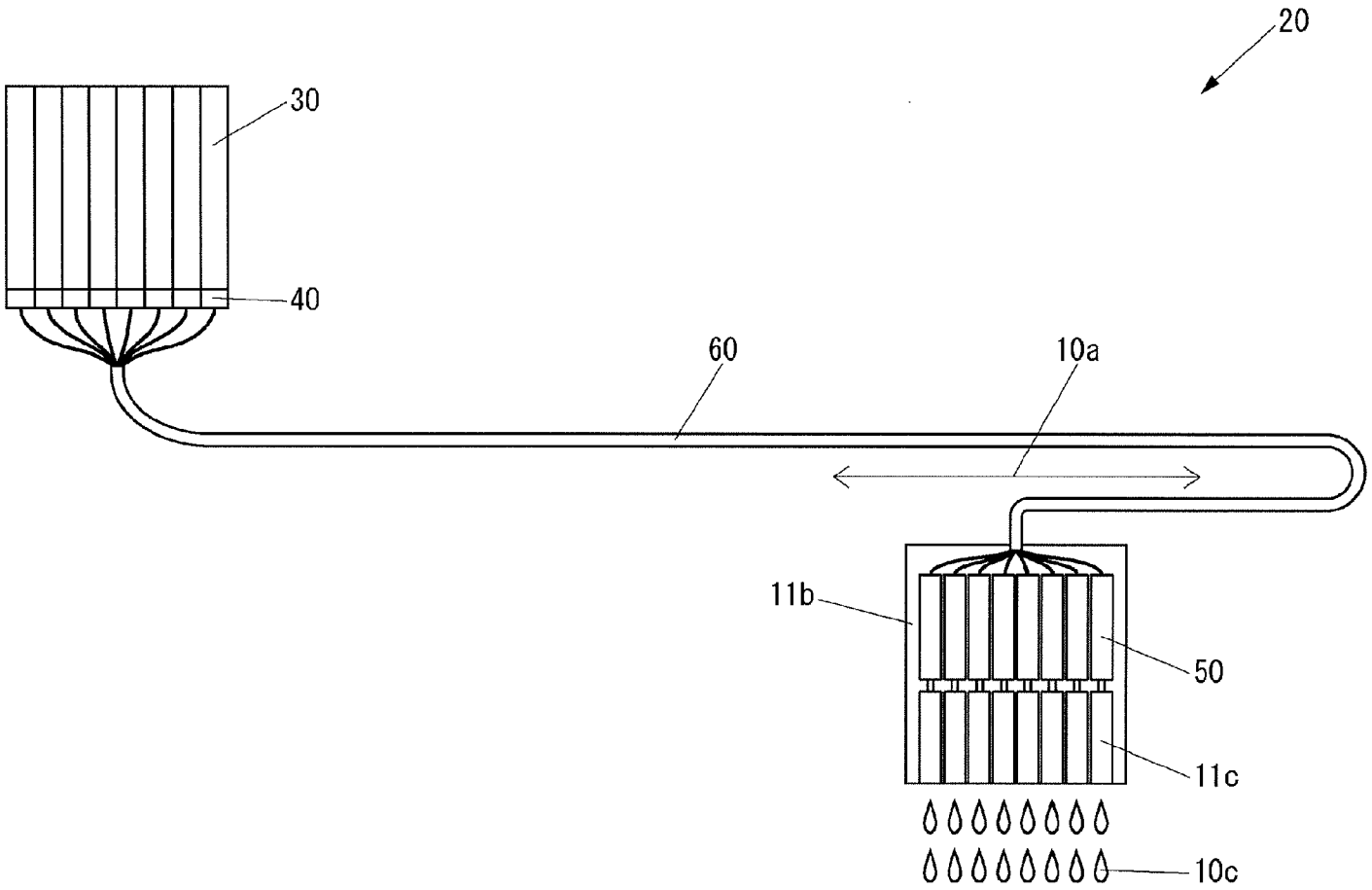
FIG. 2 is a schematic view of an ink supply device shown in FIG. 1.

FIG. 2 is a schematic view of the ink supply device 20.

As shown in FIG. 1 and FIG. 2, the ink supply device 20 is a device for supplying ink 10*c* to the recording heads 11*c* that discharge ink 10*c*. It should be noted that, as the ink 10*c*, arbitrary ink may be employed, such as aqueous ink, latex ink, solvent ink, UV ink, and solvent UV ink.

The ink supply device 20 includes replaceable ink containers 30 that are containers storing the deaerated ink 10*c*, and that are replaceable, bases 40 to and from which the replaceable ink containers 30 are attached and detached, carriage-mounting type ink supply devices 50 that are mounted on the carriage 11*b*, and that are for supplying the ink 10*c* to the recording heads 11*c*, and a tube 60 that forms a passage of the ink 10*c* between the bases 40 and the carriage-mounting type ink supply devices 50.

The replaceable ink containers 30, the bases 40, the carriage-mounting type ink supply devices 50, and the recording heads 11*c* have positions in a vertical direction that are descending in this order.

The replaceable ink containers 30 are large capacity containers, of which capacity is for example 2 liters.

The carriage-mounting type ink supply devices 50 are arranged between the recording heads 11*c* and the replaceable ink containers 30 on the passage of the ink 10*c*. Each carriage-mounting type ink supply device 50 preferably includes a mechanism to maintain pressure of the ink 10*c* to be supplied to the recording head 11*c* in a predetermined range of negative pressure, and a mechanism as a pressure damper that moderates fluctuation of the pressure of the ink 10*c* caused by the movement of the recording head 11*c*.

Here, the replaceable ink containers 30 and the bases 40 are fixed relative to the main body 11, and do not move in the main scanning direction shown by the arrow 10*a*.

On the other hand, the recording heads 11*c* and the carriage-mounting type ink supply devices 50 are mounted on the carriage 11*b*, and are configured to move in the main scanning direction shown by the arrow 10*a* together with the carriage 11*b*.

The tube 60 has flexibility. Thus, even if the recording heads 11*c* and the carriage-mounting type ink supply devices 50 move in the direction shown by the arrow 10*a* relative to the replaceable ink containers 30 and the bases 40, a portion within the tube 60 on the passage of the ink 10*c* closer to the carriage-mounting type ink supply devices 50 deforms, and the ink 10*c* is supplied to the carriage-mounting type ink supply devices 50 from the bases 40 via the tube 60.

Figure 3:
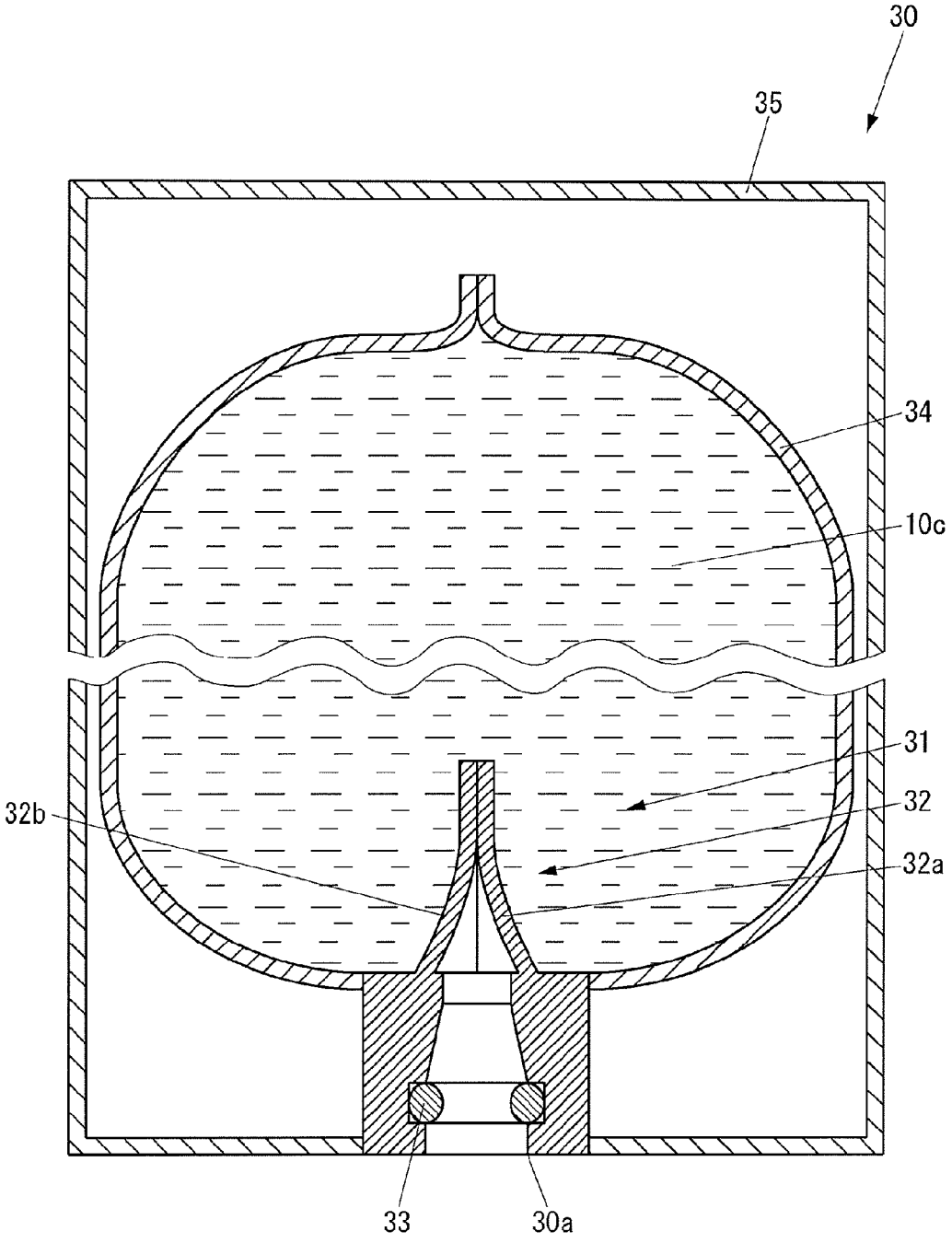
FIG. 3 is a front sectional view of a replaceable ink container shown in FIG. 2.
Figure 4:
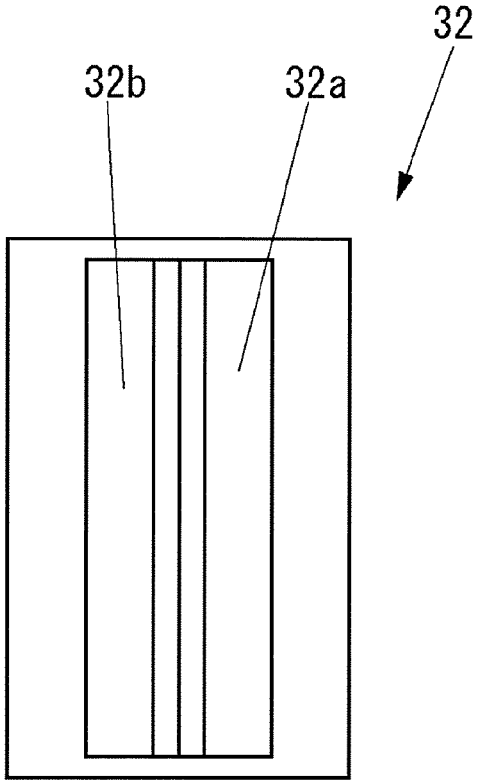
Figure 5:
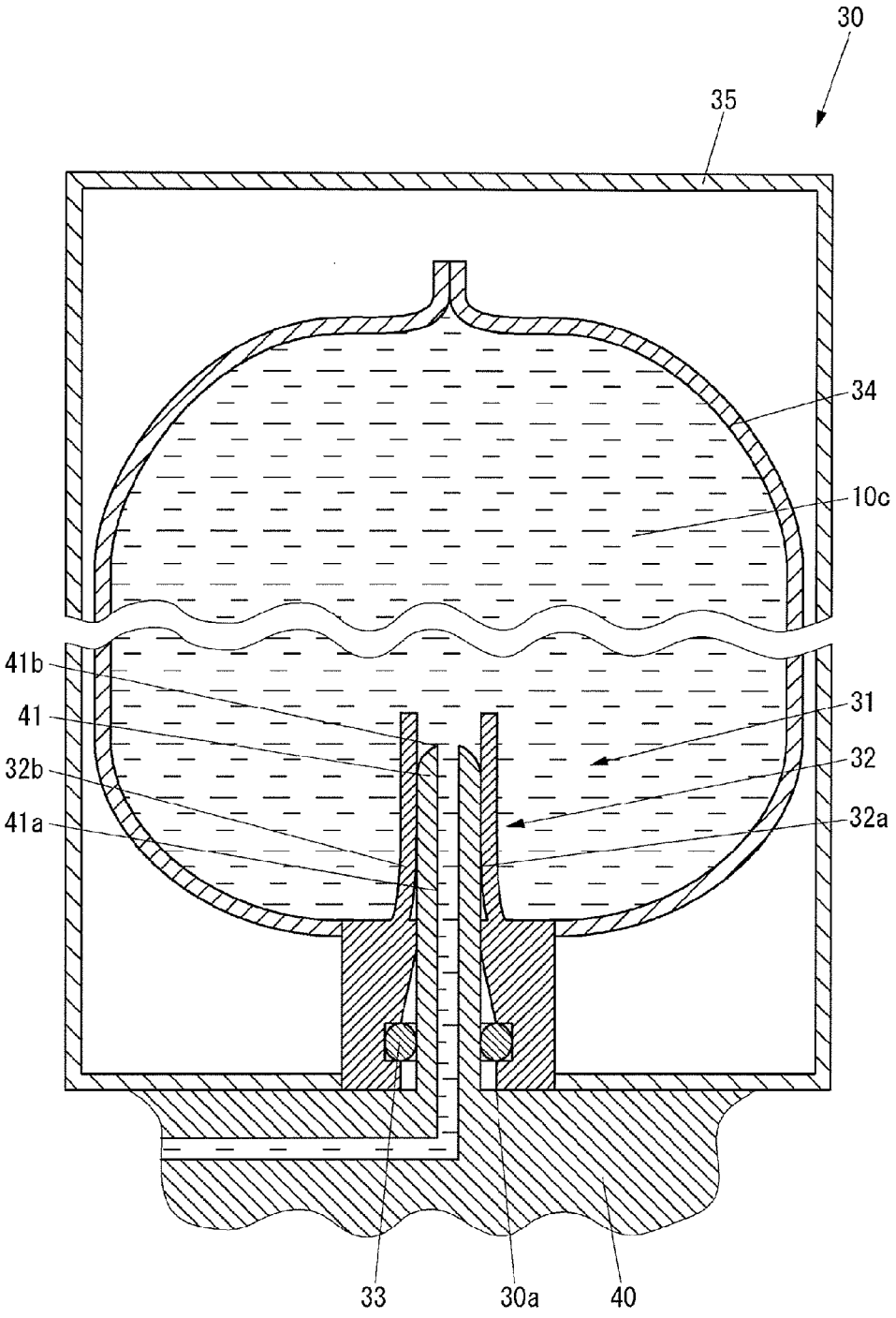
FIG. 5 is a front sectional view of the replaceable ink container shown in FIG. 2, in a state of having a male connector of a base inserted therein.
Figure 6:
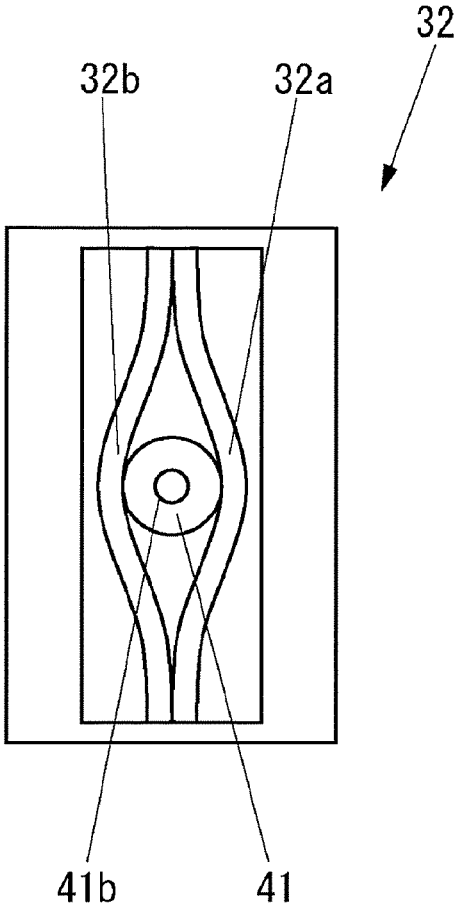
FIG. 6 is a plan view of the reed valve of the replaceable ink container in a state shown in FIG. 5.

FIG. 3 is a front sectional view of the replaceable ink container 30. FIG. 4 is a plan view of the reed valve 32 of the replaceable ink container 30 in a state shown in FIG. 3. FIG. 5 is a front sectional view of a part of the replaceable ink container 30 in a case where the male connector 41 of the base 40 is inserted therein. FIG. 6 is a plan view of the reed valve 32 of the replaceable ink container 30 in a state shown in FIG. 5.

As shown in FIG. 3 to FIG. 6, each replaceable ink container 30 has an insertion opening 30*a* into which the male connector 41 of the corresponding base 40 is inserted formed therein. The insertion opening 30*a* is provided on a lower side of the replaceable ink container 30, so that the ink 10*c* within the replaceable ink container 30 can be taken out to the last drip by self-weight of the ink 10*c*.

Further, each replaceable ink container 30 includes an opening plug 31 for plugging the insertion opening 30*a*, an ink bag 34 of which capacity is changeable according to an amount of the stored ink 10*c*, and a case 35 for housing the ink bag 34. The opening plug 31 and the ink bag 34 are integrated by methods such as integrated forming, or thereto-compression bonding.

The opening plug 31 includes a reed valve 32 that is pressed by the male connector 41 and opened when the male connector 41 is inserted into the insertion opening 30*a*, and that closes by making contact with the male connector 41 when the male connector 41 is pulled out from the insertion opening 30*a*. Further, the opening plug 31 includes an 0-ring 33 for preventing the ink 10*c* from passing through between the reed valve 32 and the male connector 41 when the reed valve 32 is opened.

The reed valve 32 includes a pair of valve bodies 32*a*, 32*b* for opening and closing.

Each of the pair of valve bodies 32*a*, 32*b* is a film-shaped flexible member. The reed valve 32 is a valve to which closing force is applied by rigidity of the pair of valve bodies 32*a*, 32*b* when the male connector 41 is pulled out from the insertion opening 30*a*. The valve bodies 32*a*, 32*b* have their entireties of both end portions in a direction vertically intersecting the inserting direction of the male connector 41 into the insertion opening 30*a*, or at least their base-side portions within the both end portions adhered to each other.

The reed valve 32 may be formed of plastic such as polyethylene, polyester, or polyimide. Further, the reed valve 32 may be formed by metal such as phosphor bronze, stainless steel, brass, steel, tungsten, or tantalum. Further, the reed valve 32 may be formed by metal such as iron or steel that is metal plated, such as by chromium plating. Further, the reed valve 32 may be formed by plywood laminate in which plastic is coated or laminated on a metal film. As the material of the reed valve 32, those that satisfy corrosion resistivity to the ink 10*c* to be used, and required rigidity can be employed.

The ink bag 34 is formed of plastic film such as polyester, polyethylene, or nylon. The plastic film may be a single layer film formed of a single material, or may be a laminate film formed of plural materials, or may be a composite film in which aluminum foil or aluminum vapor-deposited film is laminated on an inner side of the ink bag 34 relative to the plastic therein.

Figure 7A:
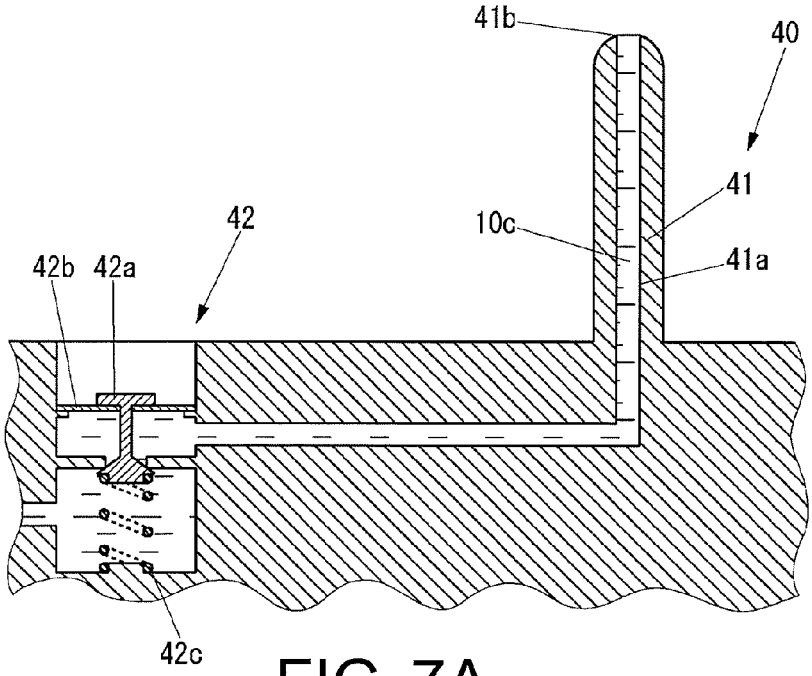
FIG. 7A is a cross sectional view of a part of the base shown in FIG. 2.
Figure 7B:
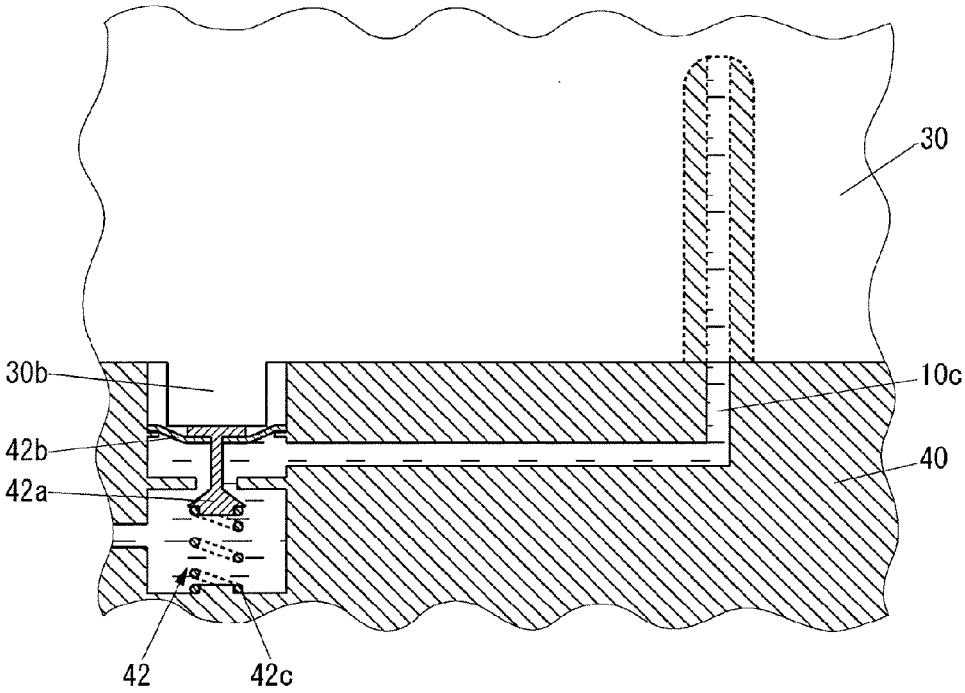
FIG. 7B is a cross sectional view of a part of the base shown in FIG. 2, in a case where the replaceable ink container is attached.

FIG. 7A is a cross sectional view of a part of the base 40. FIG. 7B is a cross sectional view of a part of the base 40, in a case where the replaceable ink container 30 is attached.

As shown in FIG. 7A and FIG. 7B, each base 40 includes the male connector 41 that is to be inserted into a replaceable ink container 30 so as to take out the ink 10*c* from the replaceable ink container 30, and a communicating valve 42 that communicates the replaceable ink container 30 and the tube 60 (see FIG. 2) in the passage of the ink 10*c*.

The male connector 41 has a passage 41*a* for the ink 10*c* formed therein. Further, the male connector 41 has an ink opening 41*b* for introducing the ink 10*c* to the passage 41*a* formed at a distal end portion.

The communicating valve 42 includes a valve body 42*a*, a diaphragm 42*b* supporting the valve body 42*a*, and a spring 42*c* biasing the valve body 42*a* in a direction along which the communicating valve 42 closes. The communicating valve 42 is a valve that opens by a protruding portion 30*b* of the replaceable ink container 30 pressing the valve body 42*a* when the replaceable ink container 30 is attached to the base 40.

Each base 40 can prevent air from being drawn into the passage of the ink 10*c* from the ink opening 41*b* of the male connector 41 when the replaceable ink container 30 is detached by the workings of the communicating valve 42 described above. Accordingly, the communicating valves 42 can prevent an occurrence of a defect by which discharge from the recording heads 11*c* becomes unstable by the air drawn into the passage of the ink 10*c*.

Figure 8:
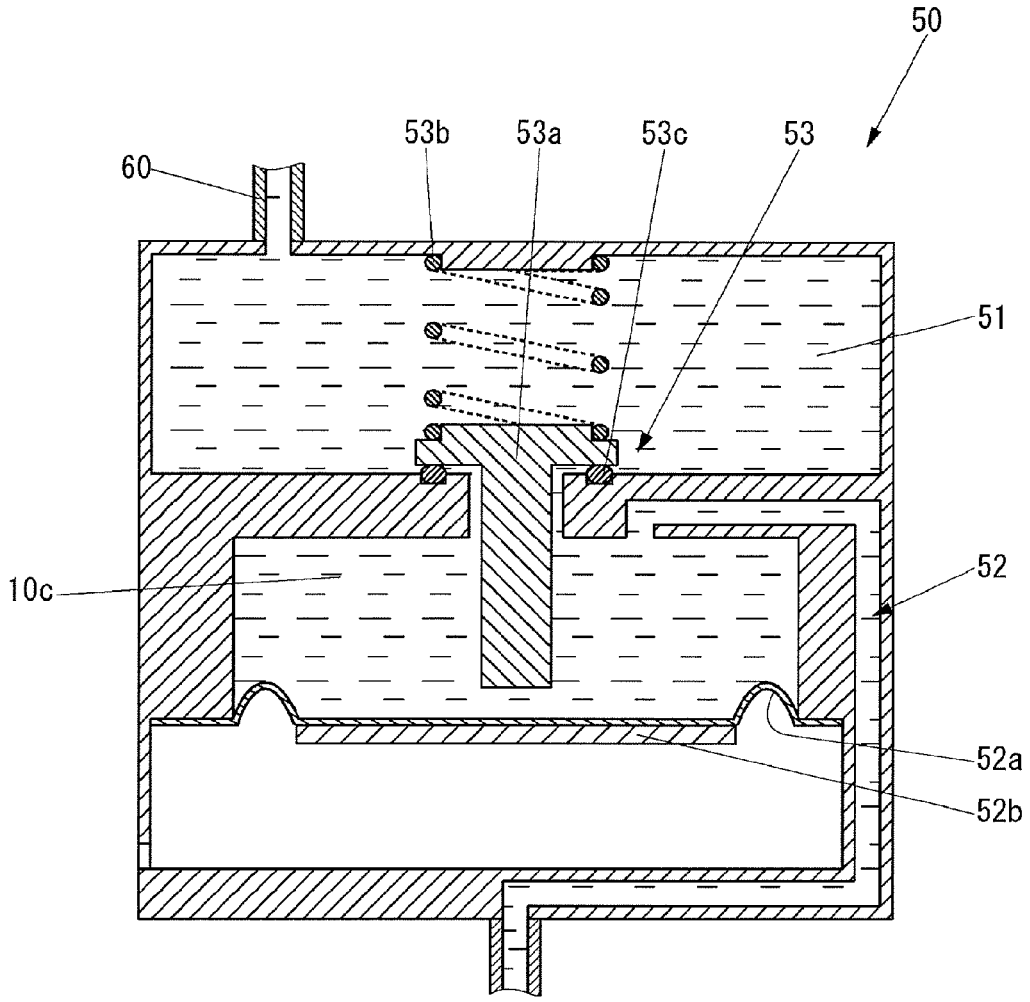
FIG. 8 is a cross sectional view of a carriage-mounting type ink supply device shown in FIG. 2.

FIG. 8 is a cross sectional view of a carriage-mounting type ink supply device 50 having a negative pressure adjusting function.

As shown in FIG. 8, each carriage-mounting type ink supply device 50 includes an ink storage unit 51 that stores the ink 10*c*, a variable capacity ink storage unit 52 of which capacity can be changed according to the stored amount of the ink 10*c*, and a valve 53 for introducing the ink 10*c* from the ink storage unit 51 to the variable capacity ink storage unit 52.

The ink storage unit 51 is communicated with a replaceable ink container 30 (see FIG. 2) via the tube 60.

The variable capacity ink storage unit 52 is communicated with a recording head 11*c* (see FIG. 2). The variable capacity ink storage unit 52 includes a film 52*a* that deforms according to a change in the capacity of the variable capacity ink storage unit 52, and a pressure receiving plate 52*b* that moves together with the change in the capacity of the variable capacity ink storage unit 52 and receives atmospheric pressure on one surface side.

The valve 53 includes a valve body 53*a*, a spring 53*b* that biases the valve body 53*a* in a direction along which the valve 53 closes, and an O-ring 53*c* for preventing the ink 10*c* from passing through the valve 53 when the valve 53 is closed. The valve 53 introduces the ink 10*c* from the ink storage unit 51 into the variable capacity ink storage unit 52 by the valve body 53*a* being pressed by the pressure receiving plate 52*b*.

The pressure receiving plate 52*b* is pressed in a direction along which the capacity of the variable capacity ink storage unit 52 increases, by the force received from the pressure of the ink 10*c* in the variable capacity ink storage unit 52 and the force of gravity that the pressure receiving plate 52*b* itself receives. Accordingly, when the valve 53 is closed, the pressure of the ink 10*c* in the variable capacity ink storage unit 52 is negative pressure.

Here, if the amount of the ink 10*c* in the variable capacity ink storage unit 52 decreases due to the ink 10*c* being discharged by the recording head 11*c*, the pressure receiving plate 52*b* elevates accompanying the decrease in the capacity of the variable capacity ink storage unit 52. When elevated, the pressure receiving plate 52*b* makes contact with the valve body 53*a* and opens the valve 53 by pushing up the valve body 53*a*. When the valve 53 is opened, the ink 10*c* is introduced into the variable capacity ink storage unit 52 from the ink storage unit 51 through the valve 53. When the ink 10*c* is introduced into the variable capacity ink storage unit 52, the capacity of the variable capacity ink storage unit 52 increases, along which the pressure receiving plate 52*b* descends, and the valve 53 is closed again.

The carriage-mounting type ink supply device 50 maintains the pressure of the ink 10*c* supplied to the recording head 11*c* as negative pressure within the predetermined range by the workings of the variable capacity ink storage unit 52 and the valve 53 as described above.

Next, functions of the opening plugs 31 of the replaceable ink containers 30 will be described.

In a case where its opening plugs 31 are in a state shown in FIG. 3 and FIG. 4, each replaceable ink container 30 has the reed valve 32 closed. That is, in the case where the opening plug 31 is in the state shown in FIG. 3 and FIG. 4, each reed valve 32 is tightly closed by receiving force in a direction along which the pair of valve bodies 32*a*, 32*b* is tightly making contact with each other by the rigidity of the valve bodies 32*a*, 32*b* and the pressure from the ink 10*c*. Accordingly, the replaceable ink containers 30 can prevent the stored ink 10*c* from leaking out to outside through the insertion openings 30*a* by the reed valves 32 when the opening plugs 31 are in the state shown in FIG. 3 and FIG. 4.

When the replaceable ink container 30 is attached to the base 40, the male connector 41 of the base 40 is inserted into the insertion opening 30*a*. Then, the male connector 41 that has been inserted into the insertion opening 30*a* makes contact with the pair of valve bodies 32*a*, 32*b* of the reed valve 32, and pushes the valve body 32*a* and the valve body 32*b* apart. Here, if the reed valve 32 has been closed as shown in FIG. 3 and FIG. 4, the reed valve 32 opens by the valve body 32*a* and the valve body 32*b* being pushed apart by the male connector 41. That is, in the replaceable ink container 30, the reed valve 32 is opened, and the opening plug 31 comes to be in a state shown in FIG. 5 and FIG. 6. Accordingly, the ink 10*c* in the replaceable ink container 30 becomes capable of being taken out to the outside via the opening plug 31 and the male connector 41.

Here, in the case where the replaceable ink container 30 is attached to the base 40, as shown in FIG. 7B, the communicating valve 42 of the base 40 is opened. Accordingly, among the ink 10*c* supplied to the carriage-mounting type ink supply device 50 via the base 40 and the tube 60 from the replaceable ink container 30, the recording head 11*c* can discharge the ink 10*c* of which pressure is maintained in negative pressure in the predetermined range by the carriage-mounting type ink supply device 50.

In a case where the opening plug 31 is in a state shown in FIG. 5 and FIG. 6, when the replaceable ink container 30 is detached from the base 40, the male connector 41 of the base 40 is pulled down relative to the opening plug 31. Further, when the male connector 41 is pulled down relative to the opening plug 31, the reed valve 32 closes by the male connector 41 being pulled out from between the valve body 32*a* and the valve body 32*b*. That is, the reed valve 32 is automatically closed tightly by receiving force in the direction along which the pair of valve bodies 32*a*, 32*b* makes tight contact with each other by the rigidity of the valve bodies 32*a*, 32*b* and the pressure from the ink 10*c*. When the male connector 41 is further pulled down relative to the opening plug 31, it is pulled out from the insertion opening 30*a*. That is, the replaceable ink container 30 has the reed valve 32 closed, and the opening plug 31 returns to the state shown in FIG. 3 and FIG. 4.

As described above, the ink supply device 20 can reduce the possibility that the ink 10*c* may leak from the replaceable ink containers 30 compared to in the conventional configuration, since the reed valves 32 receiving the pressure of the ink 10*c* automatically close when the male connectors 41 of the bases 40 are pulled out from the replaceable ink containers 30.

It should be noted that, as a case where the male connectors 41 are pulled out from the replaceable ink containers 30 in a state where the ink 10*c* still remains in the replaceable ink containers 30, for example, there may be a case where the type of the ink 10*c* to be used by the inkjet printer 10 needs to be changed, or a case where replaceable ink containers 30 storing cleaning liquid are to be attached to the bases 40 instead of the replaceable ink containers 30 storing the ink 10*c*, in order to clean the passage of the ink 10*c* from the bases 40 to nozzles that are not shown in the recording heads 11*c*.

The reed valves 32 of the replaceable ink containers 30 are valves that close by receiving the pressure of the ink 10*c* when the male connectors 41 are pulled out from the insertion openings 30*a*. Accordingly, the ink supply device 20 can improve the certainty that the reed valves 32 will close by the reed valves 32 being applied with the closing force by receiving the pressure of the ink 10*c* when the male connectors 41 are pulled out from the replaceable ink containers 30.

The reed valves 32 of the replaceable ink containers 30 are valves to which the closing force is applied by the rigidity of the pairs of valve bodies 32*a*, 32*b* when the male connectors 41 are pulled out from the insertion openings 30*a*. Accordingly, the ink supply device 20 can improve the certainty that the reed valves 32 will close by the reed valves 32 being applied with the closing force by the rigidity of the pairs of valve bodies 32*a*, 32*b* when the male connectors 41 are pulled out from the replaceable ink containers 30.

It should be noted that the reed valves 32 may not be valves to which the closing force is applied by the rigidity of the pairs of valve bodies 32*a*, 32*b* when the male connectors 41 are pulled out from the insertion openings 30*a*.

Figure 9:
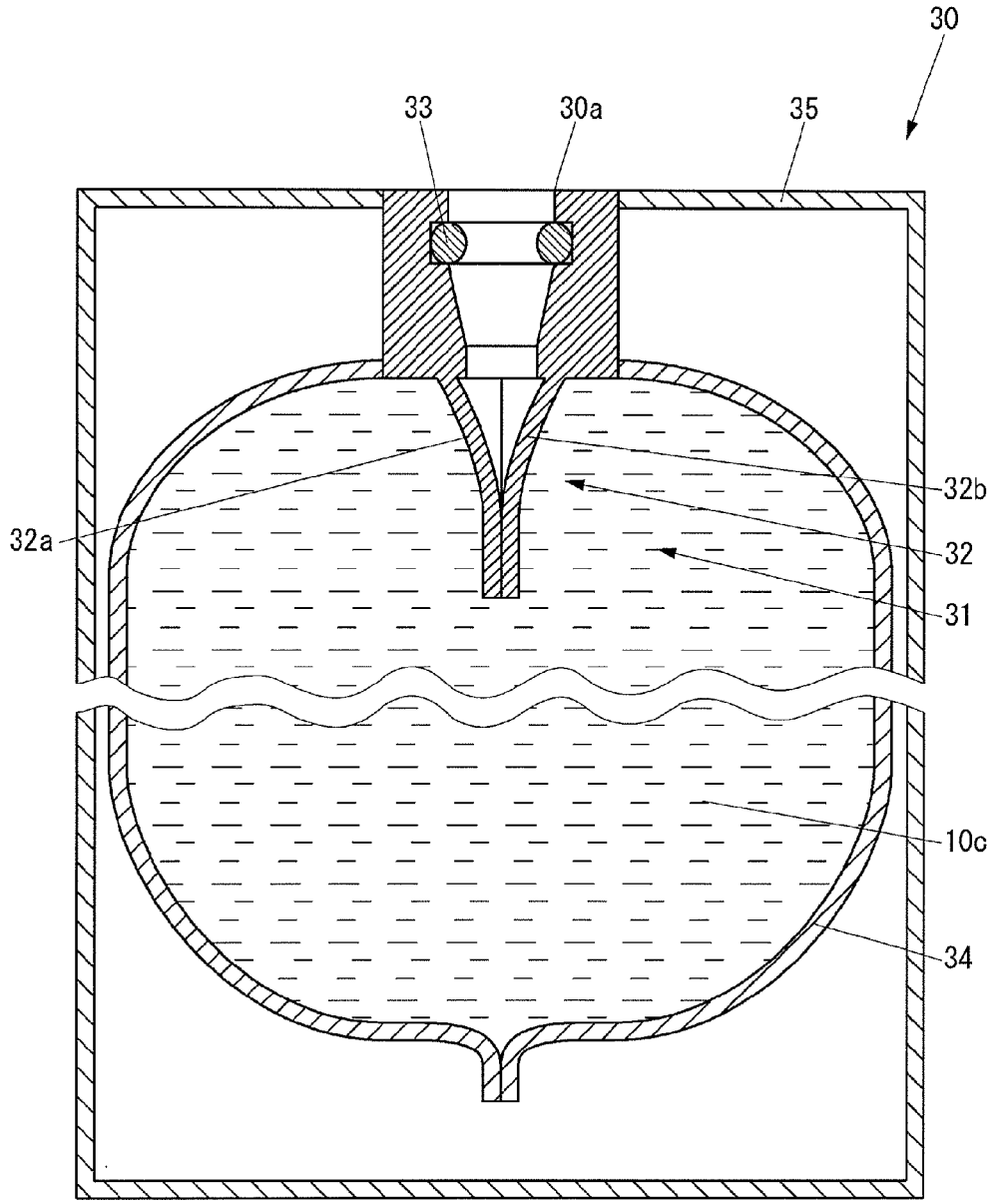
FIG. 9 is a front sectional view of a part of the replaceable ink container shown in FIG. 2 in an example different from the example shown in FIG. 3.
Figure 10:
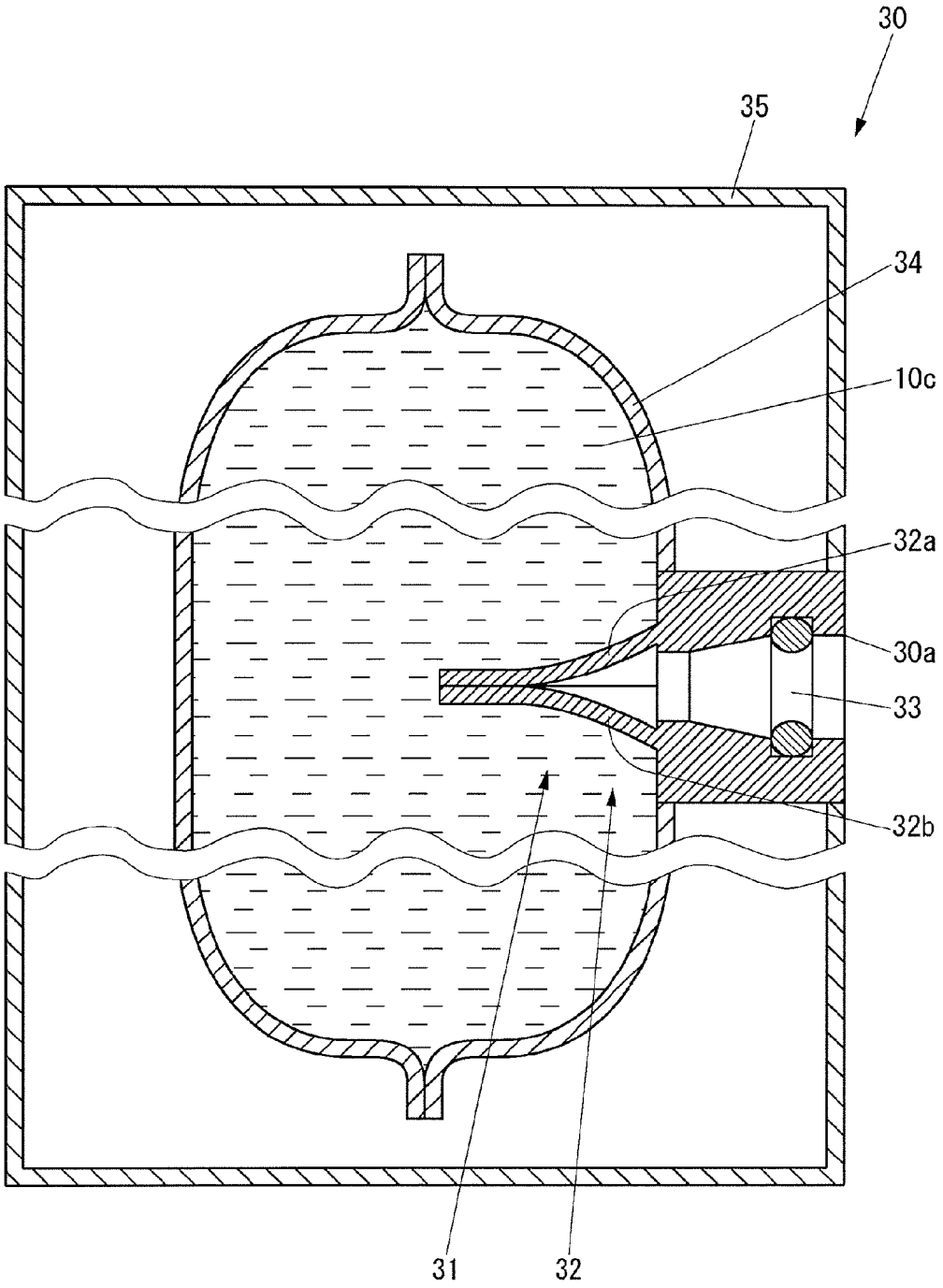
FIG. 10 is a front sectional view of a part of the replaceable ink container shown in FIG. 2 in an example different from the examples shown in FIG. 3 and FIG. 9.

The reed valve 32 can close by utilizing the pressure of the ink 10*c* even in the case where the remaining amount of the ink 10*c* in the ink bag 34 becomes scarce, due to being arranged at a position where it can receive positive pressure from the ink 10*c* even in the case where the remaining amount of the ink 10*c* in the ink bag 34 becomes scarce, that is, at a lower portion of the ink bag 34. However, if the rigidity of the reed valve 32 itself is high to a degree by which the reed valve 32 can keep it closed against the negative pressure of the ink 10*c*, the opening plug 31 can be arranged at any arbitrary position in the ink bag 34. For example, the opening plug 31 may be arranged at an upper portion of the ink bag 34 as shown in FIG. 9, or may be arranged at a center in the vertical direction in the ink bag 34 as shown in FIG. 10. As a method to increase the rigidity of the reed valve 32 itself, there are methods of forming the reed valve 32 by materials with strong elasticity, or methods that increase thicknesses of the valve bodies 32*a*, 32*b* of the reed valve 32, and the like.

Figure 11A:
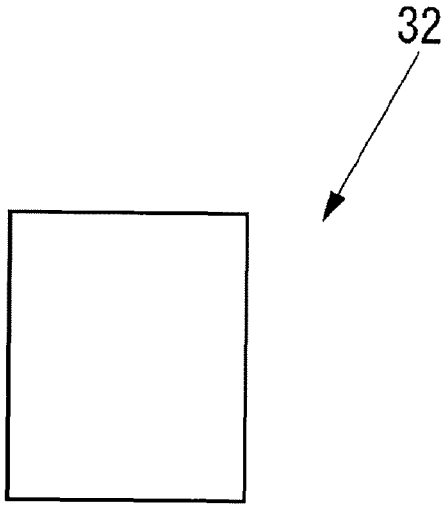
FIG. 11A is a side view of an example of the reed valve shown in FIG. 3.
Figure 11B:
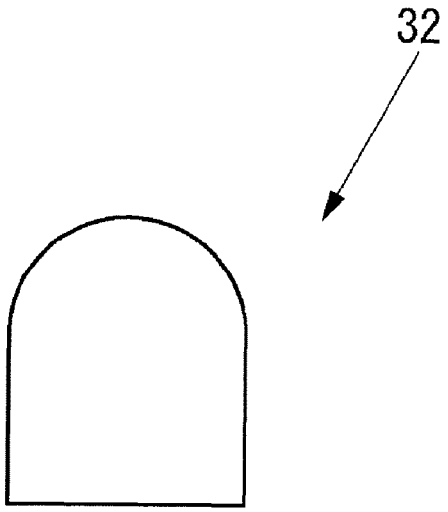
FIG. 11B is a side view of an example of the reed valve shown in FIG. 3 in an example different from the example shown in FIG. 11A.

A shape of the reed valve 32 may be a shape other than the shape shown in the embodiment. As the reed valve 32, any arbitrary valve can be employed so long as it is a valve that is opened and closed by insertion and pullout of the male connector 41. For example, the shape of the reed valve 32 may be square as shown in FIG. 11A, or may be a square with one end in a semicircle as shown in FIG. 11B, and any arbitrary shape such as triangle, semicircle, and trapezoid may be employed.

Figure 12:
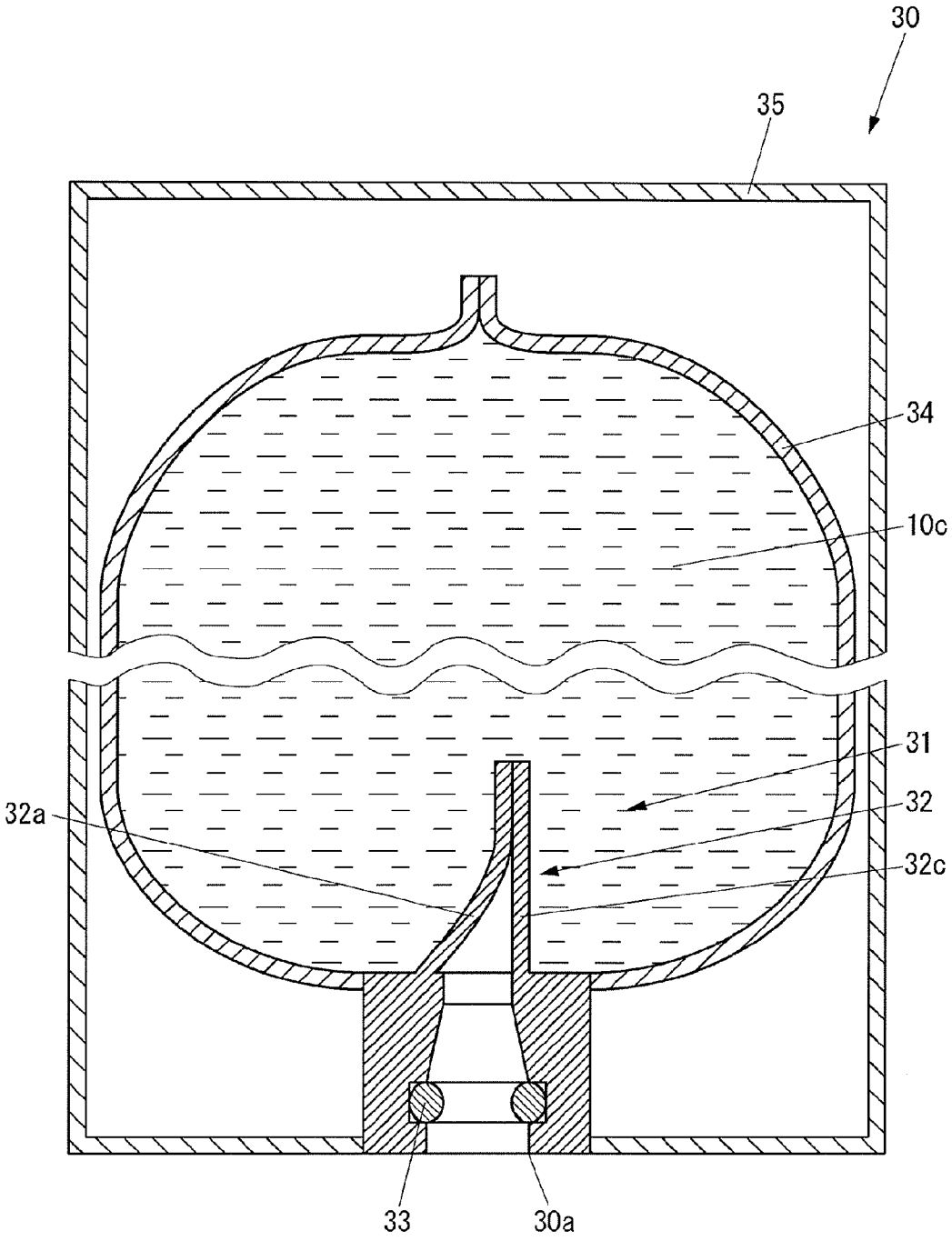
FIG. 12 is a front sectional view of a part of the replaceable ink container shown in FIG. 2 in an example different from the examples shown in FIGS. 3, 9, and 10.

Further, in the present embodiment, the reed valve 32 is configured of the film-formed pair of valve bodies 32*a*, 32*b* having elasticity, however, it may be configured of a film-formed valve body 32*a* having elasticity and a member 32*c* that is a rigid member and hardly exhibits any deformation, as shown in FIG. 12. Even in the configuration as shown in FIG. 12, the reed valve 32 can achieve similar workings and effects as the case with the configuration shown in FIG. 3.

Figure 13:
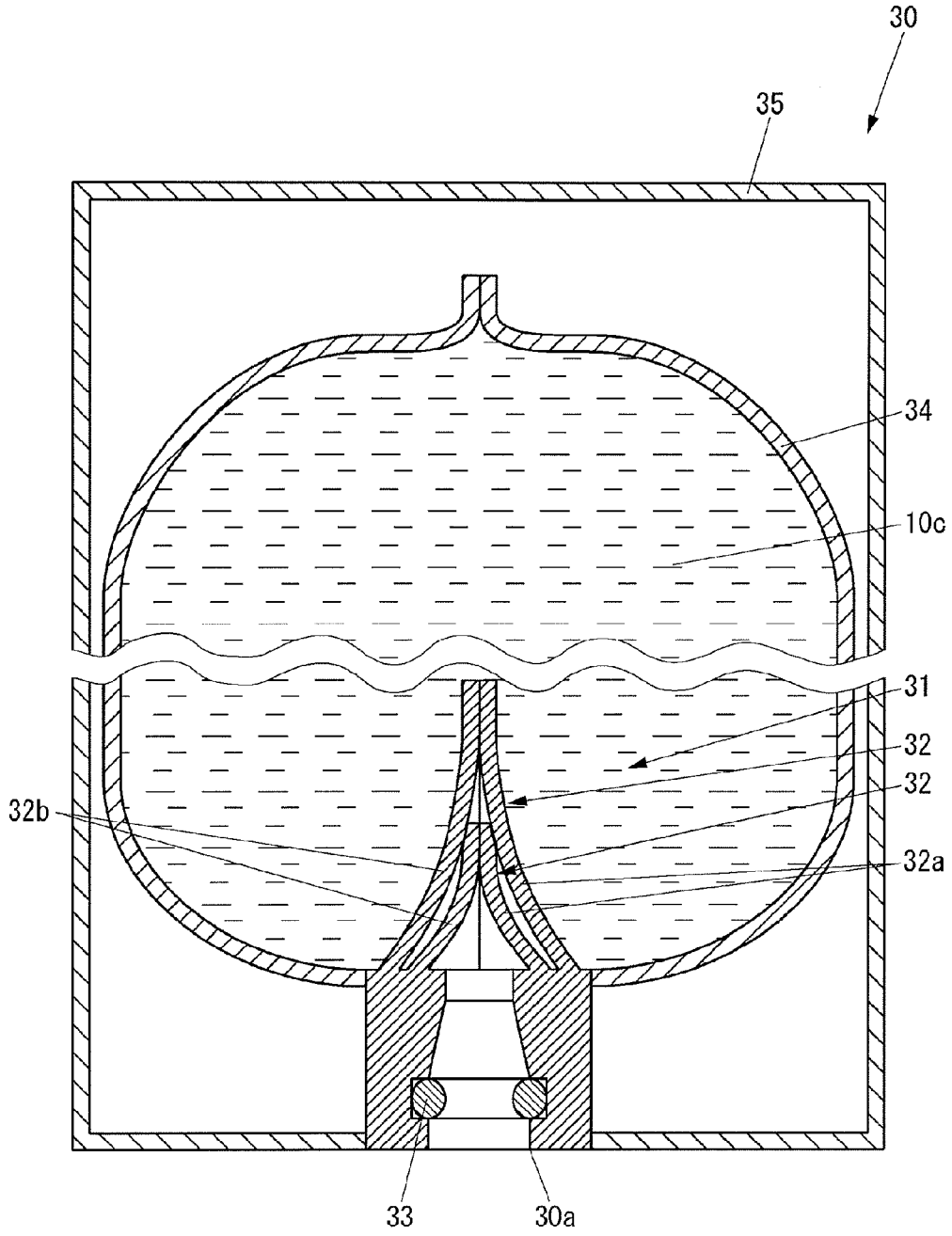
FIG. 13 is a front sectional view of a part of the replaceable ink container shown in FIG. 2 in an example different from the examples shown in FIGS. 3, 9, 10, and 12.

Further, the opening plug 31 includes one reed valve 32 in the embodiment, however, as shown in FIG. 13, two consecutive reed valves 32 may be provided. In the case of the configuration shown in FIG. 13, even if a defect occurs in one reed valve 32 of the two consecutive reed valves 32, the opening plug 31 can prevent the occurrence of leak of the ink 10*c* and the like by the other reed valve 32.

Further, a shape of the male connector 41 of the base 40 may be a shape other than the shape shown in the embodiment.

Figure 14A:
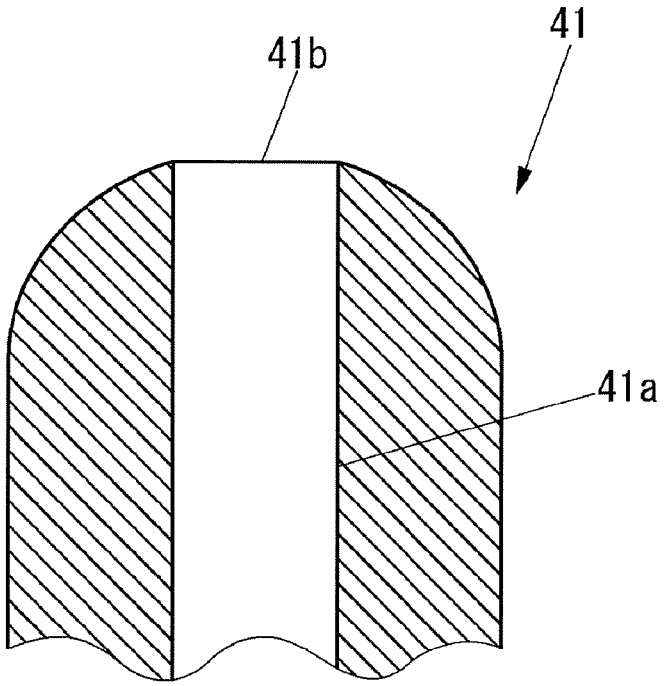
FIG. 14A is a side sectional view of another example of the male connector shown in FIGS. 7A and 7B.
Figure 14B:
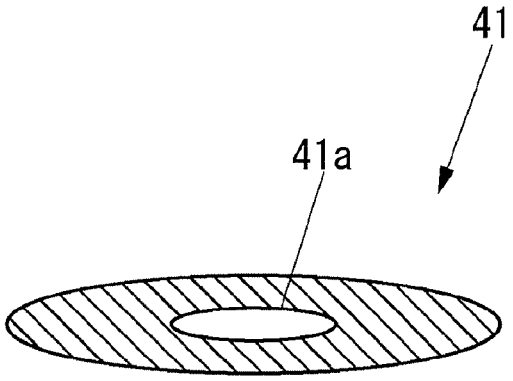
FIG. 14B is a plan view of the male connector shown in FIG. 14A.

For example, as shown in FIG. 14A and FIG. 14B, the male connector 41 may have a shape in a cross section vertically intersecting the direction of insertion into the insertion opening 30*a* of the replaceable ink container 30 in an elongated shape. According to this configuration, as compared to the configuration in which cross section of the male connector 41 vertically intersecting the direction of insertion of the male connector 41 into the insertion opening 30*a* is not in the elongated shape as shown in FIG. 5 and FIG. 6, when the male connector 41 is inserted into the insertion opening 30*a*, the ink supply device 20 has small force applied to both end portions of the reed valve 32 in the direction vertically intersecting the insertion direction of the male connector 41 into the insertion opening 30*a*, so that the force required for the insertion of the male connector 41 into the insertion opening 30*a* can be reduced, and the life of the reed valve 32 can be extended. Further, if the shape in the cross section of the male connector 41 vertically intersecting the direction of insertion of the male connector 41 into the insertion opening 30*a* is in the elongated shape, the ink supply device 20 can increase a flow rate of the ink 10*c* relative to a degree of opening of the reed valves 32 as compared to the configuration in which the cross section of the male connector 41 vertically intersecting the direction of insertion of the male connector 41 into the insertion opening 30*a* is not in the elongated shape.

Further, the male connector 41 of the base 40 and the reed valve 32 of the replaceable ink container 30 may be configured to be fitted with each other to a degree by which the ink 10*c* does not leak out from between the male connector 41 and the reed valve 32 when the male connector 41 has been inserted into the insertion opening 30*a*. According to this configuration, the ink supply device 20 can do away with members for preventing the ink 10*c* from leaking out from between the male connector 41 and the reed valve 32, such as the O-ring 33.

Further, the O-ring 33 of the replaceable ink container 30 may be arranged at a position that prevents the ink 10*c* from passing through between the male connector 41 and the O-ring 33 itself when the male connector 41 inserted in the insertion opening 30*a* is opening the reed valve 32. According to this configuration, the ink supply device 20 can prevent the ink 10*c* from leaking out from between the male connector 41 and the opening plug 31 by the O-ring 33 even if the reed valve 32 cannot deform along with the shape of the male connector 41 at a high accuracy by a degree by which the ink 10*c* does not leak out from between the male connector 41 and the reed valve 32, so that a degree of freedom in design of the reed valve 32 can be improved as compared to a configuration in which the reed valve 32 deforms in accordance with the shape of the male connector 41 at the high accuracy which is at the degree by which no ink 10*c* leaks out from between the male connector 41 and the reed valve 32.

(Second Embodiment)

Firstly, a configuration of an inkjet printer according to the present embodiment will be described.

It should be noted that, within the configuration of the inkjet printer according to the present embodiment, components that are similar to the components of the inkjet printer 10 (see FIG. 1) according to the first embodiment will be given the same reference signs as the inkjet printer 10, and detailed descriptions thereof will be omitted.

Figure 15:
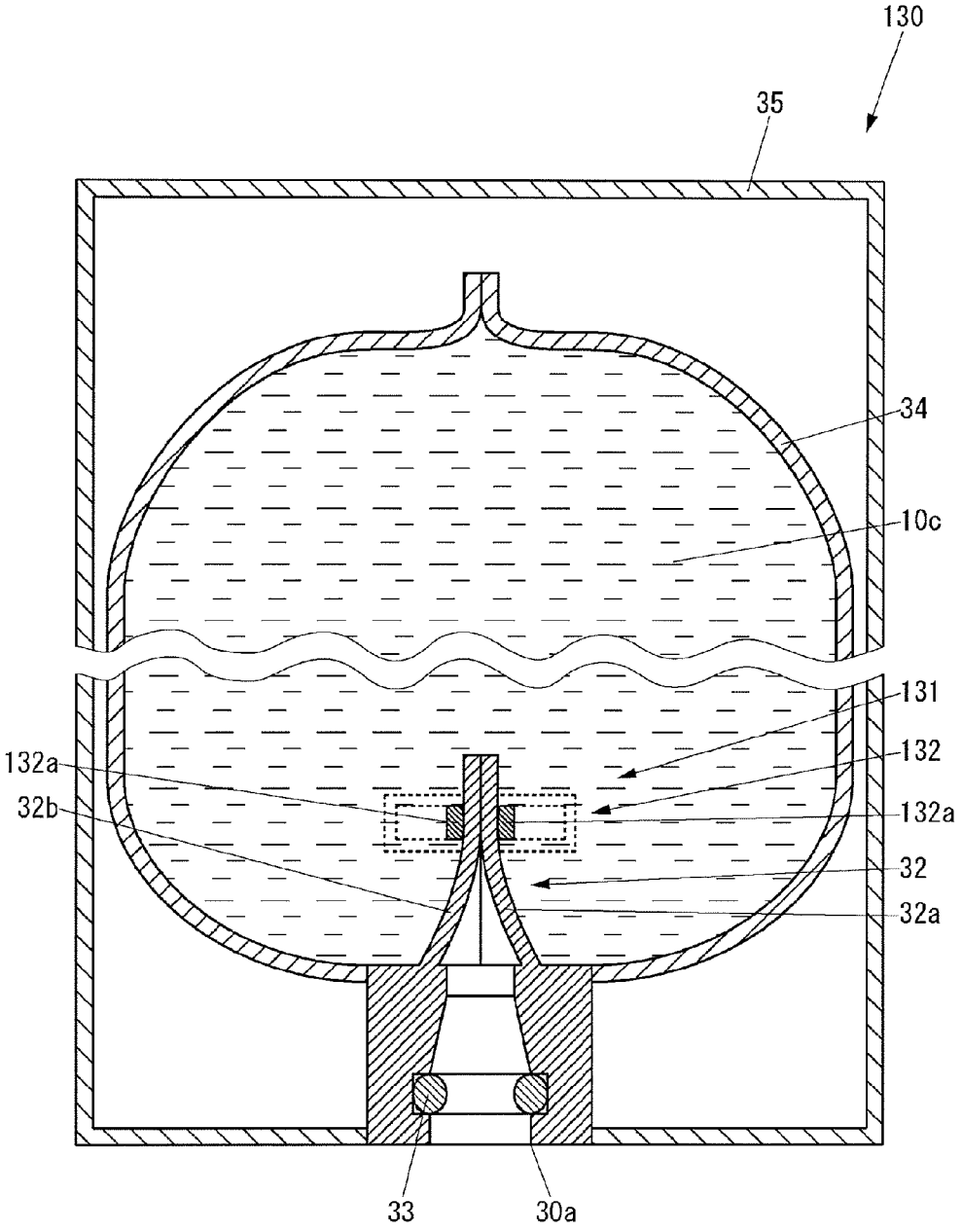
FIG. 15 is a front sectional view of a part of a replaceable ink container of an inkjet printer according to a second embodiment of the present invention.
Figure 16:
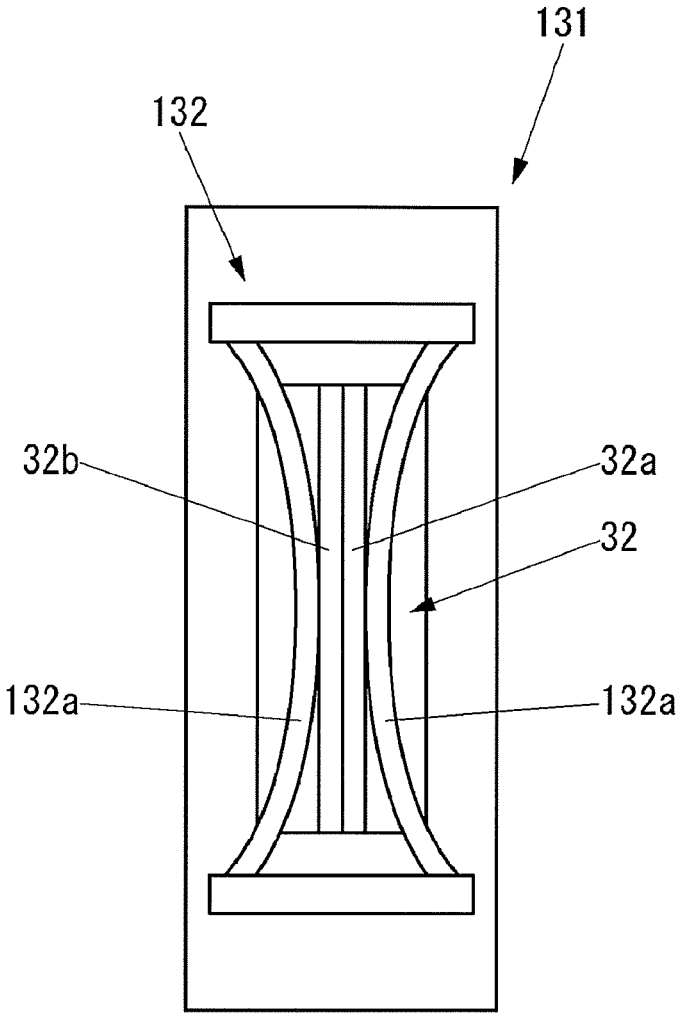
FIG. 16 is a plan view of a reed valve of a replaceable ink container in a state shown in FIG. 15.
Figure 17:
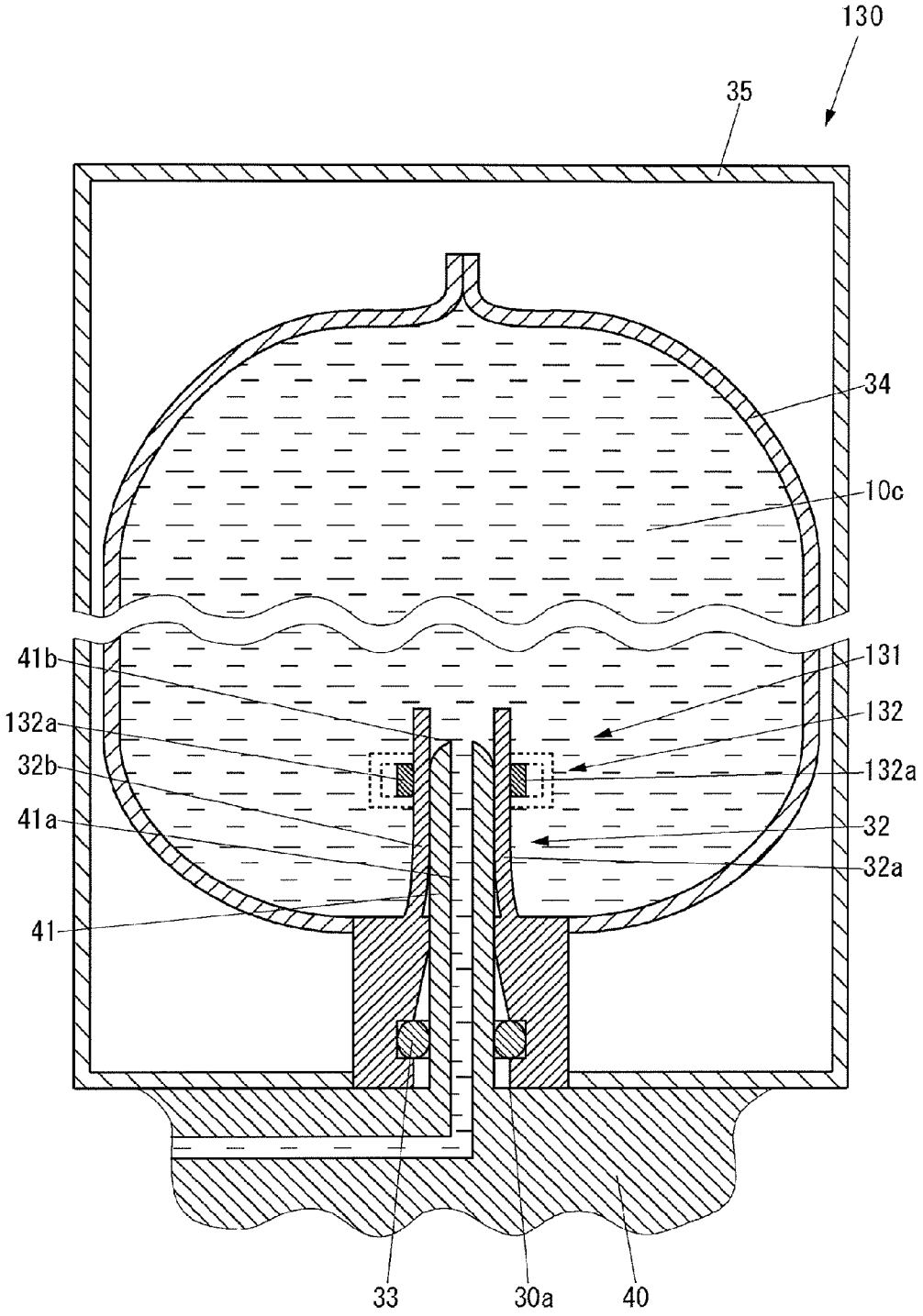
FIG. 17 is a front sectional view of a part of the replaceable ink container shown in FIG. 15 in a case where a male connector of a base is inserted therein.
Figure 18:
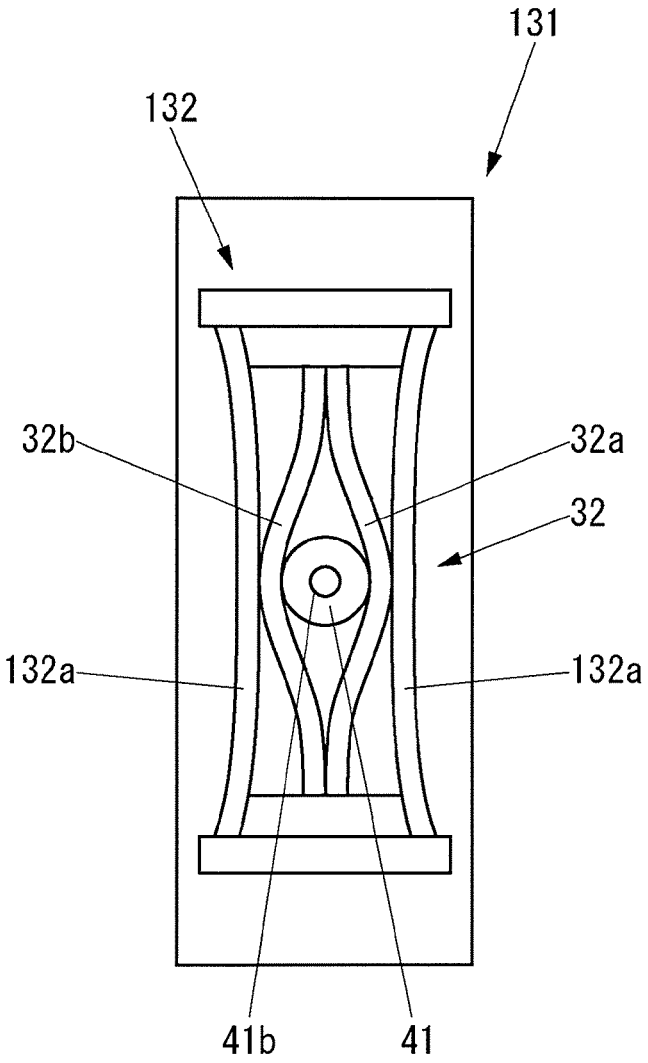
FIG. 18 is a plan view of the reed valve of the replaceable ink container in a state shown in FIG. 17.
Figure 19:
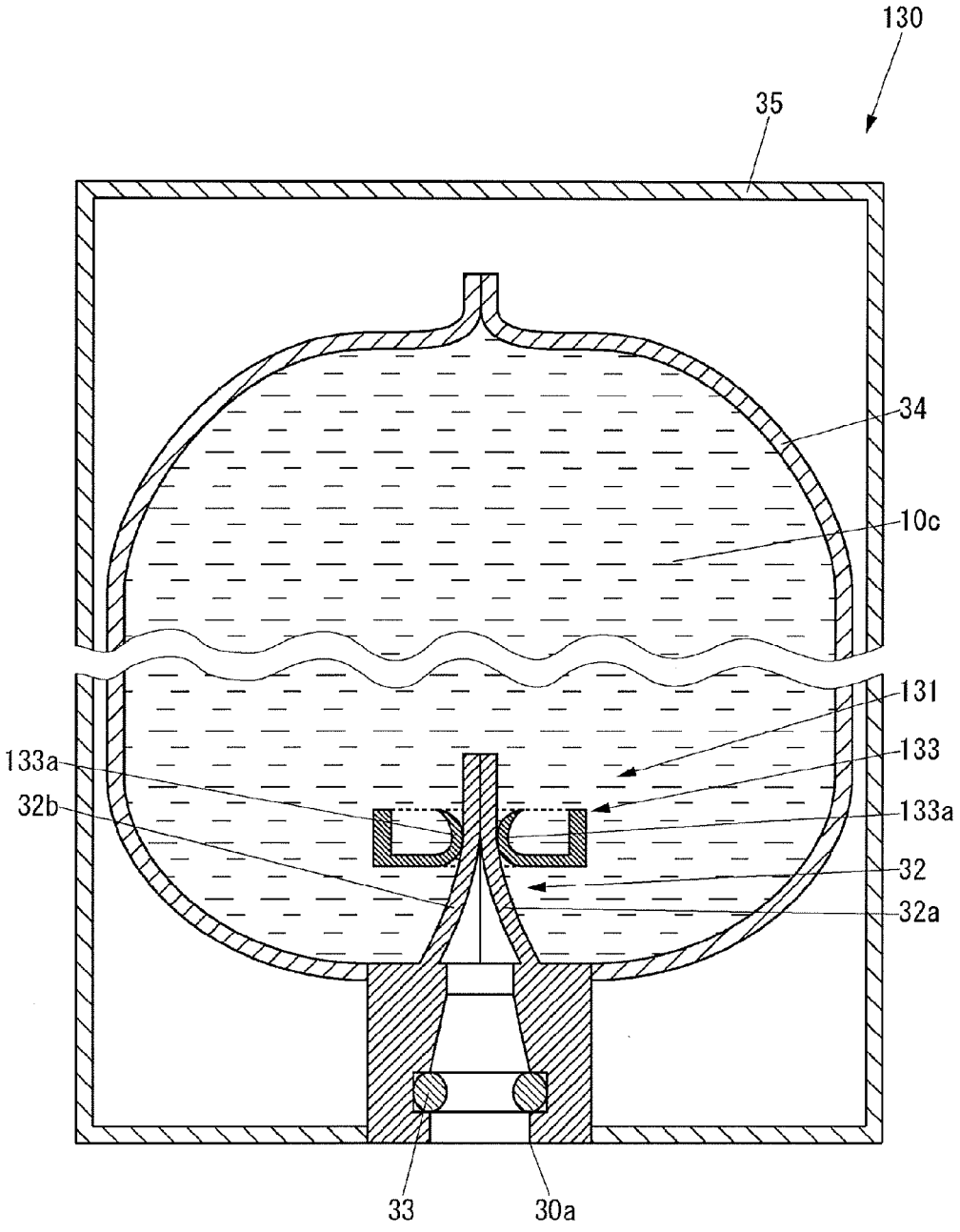
FIG. 19 is a front sectional view of a part of the replaceable ink container of the inkjet printer according to the second embodiment of the present invention in an example different from the example shown in FIG. 15.
Figure 20:
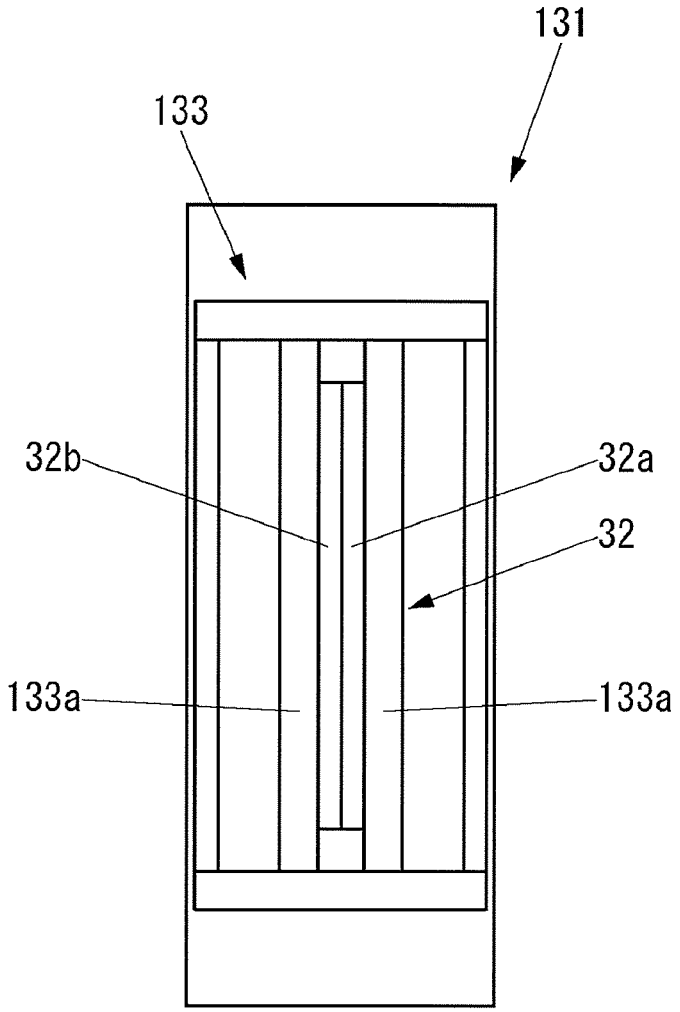
FIG. 20 is a plan view of the reed valve of the replaceable ink container in a state shown in FIG. 19.
Figure 21:
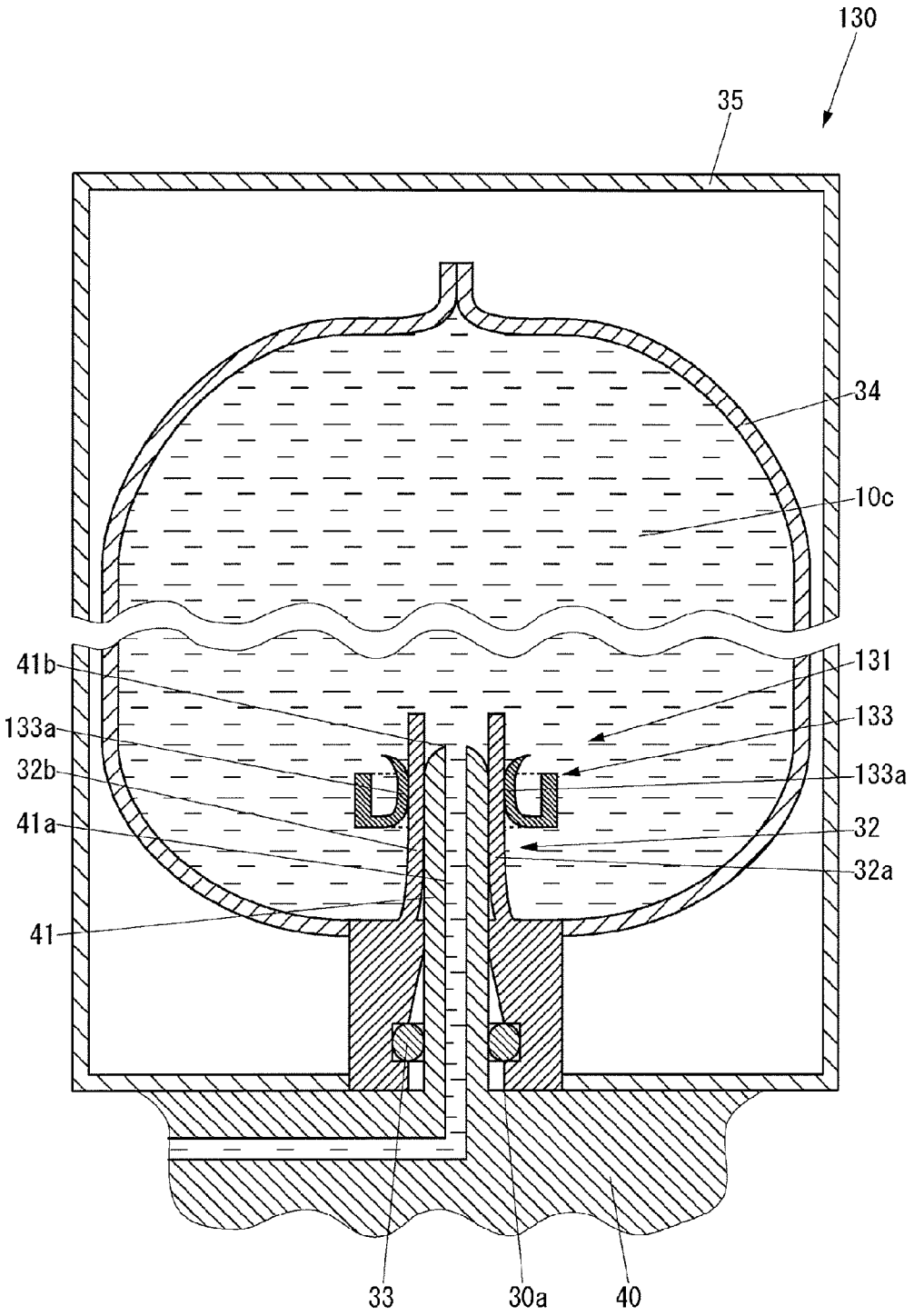
FIG. 21 is a front sectional view of a part of the replaceable ink container shown in FIG. 19 in a case where a male connector of a base is inserted therein.
Figure 22:
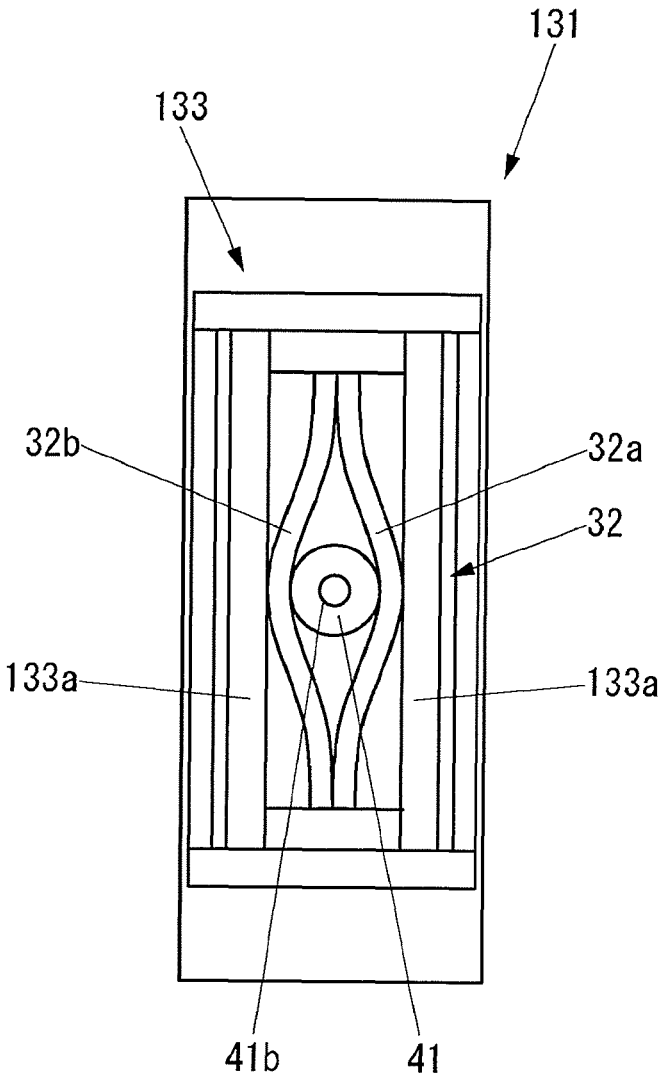
FIG. 22 is a plan view of the reed valve of the replaceable ink container in a state shown in FIG. 21.

FIG. 15 is a front sectional view of a part of a replaceable ink container 130 of an inkjet printer of the present embodiment. FIG. 16 is a plan view of a reed valve 32 of the replaceable ink container 130 in a state shown in FIG. 15. FIG. 17 is a front sectional view of a part of the replaceable ink container 130 in a case where a male connector 41 of a base 40 is inserted therein. FIG. 18 is a plan view of the reed valve 32 of the replaceable ink container 130 in a state shown in FIG. 17.

The configuration of the inkjet printer according to the present embodiment is similar to a configuration in which the inkjet printer 10 includes a replaceable ink container 130 shown in FIG. 15 to FIG. 18 instead of the replaceable ink container 30 (see FIG. 3 to FIG. 6).

As shown in FIG. 15 to FIG. 18, a configuration of the replaceable ink container 130 is similar to a configuration in which the replaceable ink container 30 includes an opening plug 131 instead of the opening plug 31 (see FIG. 3 to FIG. 6).

A configuration of the opening plug 131 is similar to a configuration in which the opening plug 31 includes a clip 132 for clipping the reed valve 32.

The clip 132 is fixed to the reed valve 32, or a portion of the opening plug 131 other than the reed valve 32 by a member that is not shown. The clip 132 includes a pair of band-shaped pressing springs 132*a*. The clip 132 is a valve biasing unit that biases the reed valve 32 in the direction along which the reed valve 32 is closed.

Next, functions of the opening plug 131 of the replaceable ink container 130 will be described.

When the opening plug 131 is in a state shown in FIG. 15 and FIG. 16, the replaceable ink container 130 has the reed valve 32 closed. That is, if the opening plug 131 is in the state shown in FIG. 15 and FIG. 16, the reed valve 32 is closed tightly by receiving force in a direction along which the pair of valve bodies 32*a*, 32*b* make tight contact with each other by the pressure of the ink 10*c* and the biasing force by the clip 132. Accordingly, if the opening plug 131 is in the state shown in FIG. 15 and FIG. 16, the replaceable ink container 130 can prevent the stored ink 10*c* from leaking out to the outside through the insertion opening 30*a* by the reed valve 32.

When the replaceable ink container 130 is attached to the base 40, the male connector 41 of the base 40 is inserted into the insertion opening 30*a*. Then, the male connector 41 that has been inserted into the insertion opening 30*a* makes contact with the pair of valve bodies 32*a*, 32*b* of the reed valve 32, and pushes the valve body 32*a* and the valve body 32*b* apart. Here, if the reed valve 32 has been closed as shown in FIG. 15 and FIG. 16, the reed valve 32 opens by the valve body 32*a* and the valve body 32*b* being pushed apart by the male connector 41. That is, in the replaceable ink container 130, the reed valve 32 is opened, and the opening plug 131 comes to be in a state shown in FIG. 17 and FIG. 18. Accordingly, the ink 10*c* in the replaceable ink container 130 becomes capable of being taken out to the outside via the opening plug 131 and the male connector 41.

In a case where the opening plug 131 is in a state shown in FIG. 17 and FIG. 18, when the replaceable ink container 130 is detached from the base 40, the male connector 41 of the base 40 is pulled down relative to the opening plug 131. Further, when the male connector 41 is pulled down relative to the opening plug 131, the reed valve 32 closes by the male connector 41 being pulled out from between the valve body 32*a* and the valve body 32*b*. That is, the reed valve 32 is automatically closed tightly by receiving force in the direction along which the pair of valve bodies 32*a*, 32*b* makes tight contact with each other by the pressure from the ink 10*c* and biasing force from the clip 132. When the male connector 41 is further pulled down relative to the opening plug 131, it is pulled out from the insertion opening 30*a*. That is, the replaceable ink container 130 has the reed valve 32 closed, and the opening plug 131 returns to the state shown in FIG. 15 and FIG. 16.

As described above, the ink supply device according to the present embodiment can reduce the possibility that the ink 10*c* may leak from the replaceable ink containers 130 compared to in the conventional configuration, since the reed valves 32 receiving the pressure of the ink 10*c* automatically close when the male connectors 41 of the bases 40 are pulled out from the replaceable ink containers 130.

The reed valves 32 of the replaceable ink containers 130 are valves that close by receiving the pressure of the ink 10*c* when the male connectors 41 are pulled out from the insertion openings 30*a*. Accordingly, the ink supply device according to the present embodiment can improve the certainty that the reed valves 32 will close by the reed valves 32 being applied with the closing force by receiving the pressure of the ink 10*c* when the male connectors 41 are pulled out from the replaceable ink containers 130.

The opening plugs 131 of the replaceable ink containers 130 include the clips 132 that biases the reed valves 32 in the direction along which the reed valves 32 are closed. Accordingly, the ink supply device according to the present embodiment can improve the certainty that the reed valves 32 will close due to the reed valves 32 being applied with the closing force by the biasing force by the clips 132 when the male connectors 41 are pulled out from the replaceable ink containers 130.

If the biasing force of the clip 132 is large enough to a degree by which the reed valve 32 can be keep closed against the negative pressure of the ink 10*c*, the opening plug 131 can be arranged at any arbitrary position in the ink bag 34. For example, the opening plug 131 may be arranged at an upper portion of the ink bag 34, or may be arranged at a center in the vertical direction in the ink bag 34.

A shape of the clip may be a shape other than the shape shown in the embodiment. For example, the clip may be clips 133 shown in FIG. 19 to FIG. 22.

The clips 133 shown in FIG. 19 to FIG. 22 is fixed to the reed valve 32, or a portion of the opening plug 131 that is other than the reed valve 32 via a member that is not shown. The clip 133 includes a pair of bar-shaped pressing springs 133*a*. The clip 133 is a valve biasing unit that biases the reed valve 32 in the direction along which the reed valve 32 is closed.

(Third Embodiment)

Firstly, a configuration of an inkjet printer according to the present embodiment will be described.

It should be noted that, among components of the inkjet printer according to the present embodiment, those similar to the components of the inkjet printer 10 according to the first embodiment (see FIG. 1) will be given the same reference signs as the components of the inkjet printer 10, and detailed descriptions thereof will be omitted.

Figure 23:
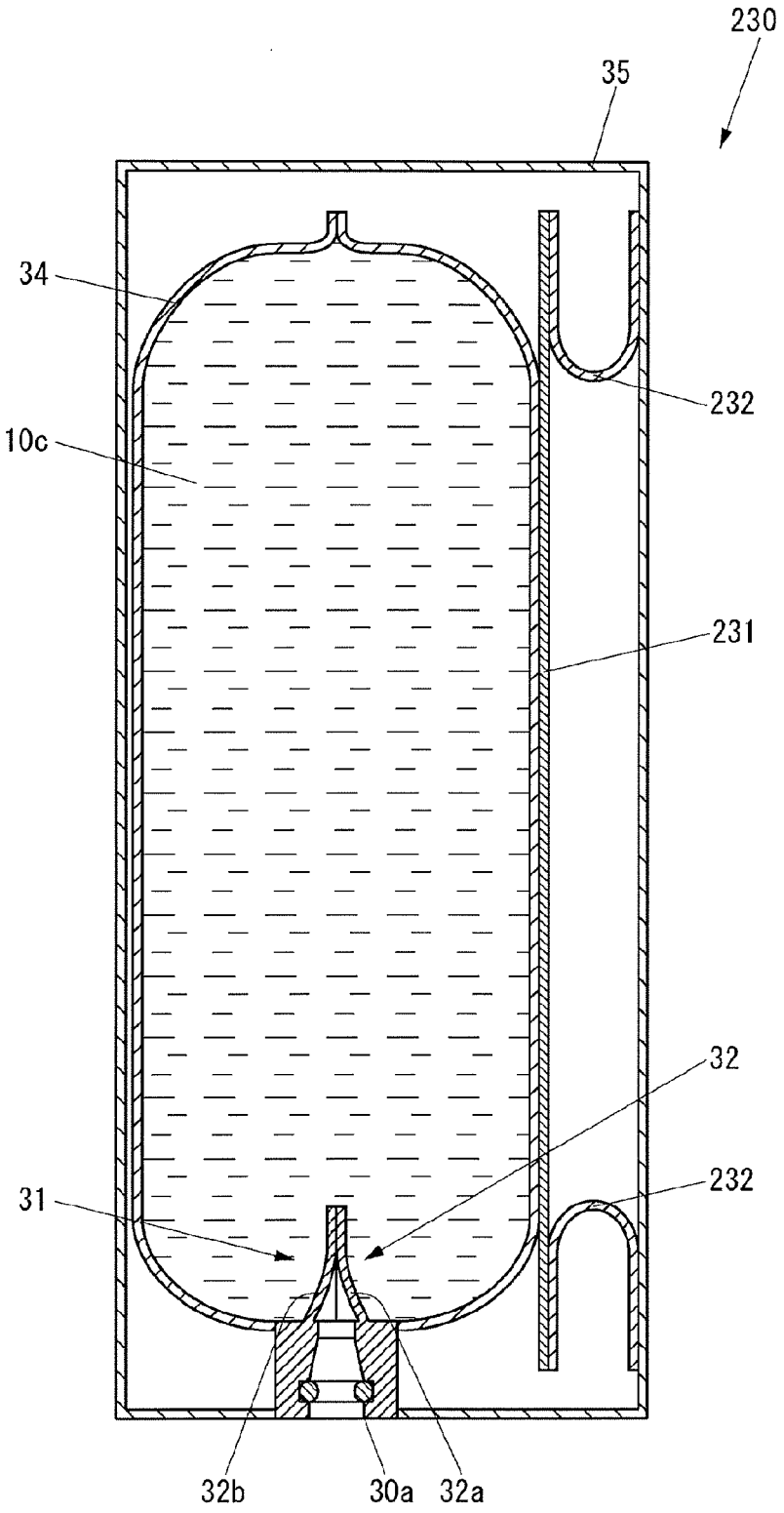
FIG. 23 is a front sectional view of a replaceable ink container of an inkjet printer according to a third embodiment of the present invention.

FIG. 23 is a front sectional view of a replaceable ink container 230 of the inkjet printer according to the present embodiment.

The configuration of the inkjet printer according to the present embodiment is similar to a configuration in which the inkjet printer 10 includes replaceable ink containers 230 shown in FIG. 23 instead of the replaceable ink containers 30 (see FIG. 3 to FIG. 6).

As shown in FIG. 23, a configuration of each replaceable ink container 230 is similar to a configuration in which the replaceable ink container 30 includes a pressing plate 231 and a pressing spring 232 as bag biasing units for biasing an ink bag 34 in a direction along which a capacity of the ink bag 34 is decreased.

Next, functions of an opening plug 31 of the replaceable ink container 230 will be described.

When a reed valve 32 of the replaceable ink container 230 is closed, it is tightly closed by a pair of valve bodies 32*a*, 32*b* receiving force in a direction along which they make tight contact with each other by pressure of the ink 10*c* that is pressurized by the pressing plate 231 and the pressing spring 232. Accordingly, if the reed valve 32 is closed, the replaceable ink container 230 can prevent the stored ink 10*c* from leaking out to the outside through the insertion opening 30*a* by the reed valve 32.

When the replaceable ink container 230 is attached to the base 40 (see FIG. 5), the male connector 41 (see FIG. 5) of the base 40 is inserted into the insertion opening 30*a*. Then, the male connector 41 that has been inserted into the insertion opening 30*a* makes contact with the pair of valve bodies 32*a*, 32*b* of the reed valve 32, and pushes the valve body 32*a* and the valve body 32*b* apart. Here, if the reed valve 32 has been closed, the reed valve 32 opens by the valve body 32*a* and the valve body 32*b* being pushed apart by the male connector 41. That is, the replaceable ink container 230 has the reed valve 32 opened. Accordingly, the ink 10*c* in the replaceable ink container 230 becomes capable of being taken out to the outside via the opening plug 31 and the male connector 41. Here, the ink 10*c* in the replaceable ink container 230 can easily be taken out to the outside by the pressure of the ink 10*c* that is pressurized by the pressing plate 231 and the pressing spring 232.

In a case where the reed valve 32 is open, when the replaceable ink container 230 is detached from the base 40, the male connector 41 of the base 40 is pulled down relative to the opening plug 31. Further, when the male connector 41 is pulled down relative to the opening plug 31, the reed valve 32 closes by the male connector 41 being pulled out from between the valve body 32*a* and the valve body 32*b*. That is, the reed valve 32 is automatically closed tightly by the pair of valve bodies 32*a*, 32*b* receiving force in the direction along which they make tight contact with each other by the pressure of the ink 10*c* that is pressurized by the pressing plate 231 and the pressing spring 232. When the male connector 41 is further pulled down relative to the opening plug 31, it is pulled out from the insertion opening 30*a*.

As described above, the ink supply device according to the present embodiment can reduce the possibility that the ink 10*c* may leak from the replaceable ink containers 230 compared to in the conventional configuration, since the reed valves 32 receiving the pressure of the ink 10*c* automatically close when the male connectors 41 of the bases 40 are pulled out from the replaceable ink containers 230.

Each replaceable ink container 230 includes the pressing plate 231 and the pressing spring 232 that bias the ink bag 34 in the direction along which the capacity of the ink bag 34 is decreased. Accordingly, since the ink supply device according to the present embodiment can maintain the pressure of the ink 10*c* inside the ink bag 34 at positive pressure, the reed valve 32 having received the pressure of the ink 10*c* can be closed automatically when the male connector 41 is pulled out from the replaceable ink container 230, even if a position of the opening plug 31 is provided at a position other than below the ink bag 34. Further, with the ink supply device according to the present embodiment, since the pressure of the ink 10*c* inside the ink bag 34 can be maintained at positive pressure, the ink 10*c* inside the replaceable ink container 230 can be taken out almost to the last drip via the male connector 41, even if the position of the opening plug 31 is provided at a position other than below the ink bag 34.

(Fourth Embodiment)

Firstly, a configuration of an inkjet printer according to the present embodiment will be described.

It should be noted that, among components of the inkjet printer according to the present embodiment, components that are similar to the components of the inkjet printer 10 (see FIG. 1) according to the first embodiment will be given the same reference signs as the inkjet printer 10, and detailed descriptions thereof will be omitted.

Figure 24:
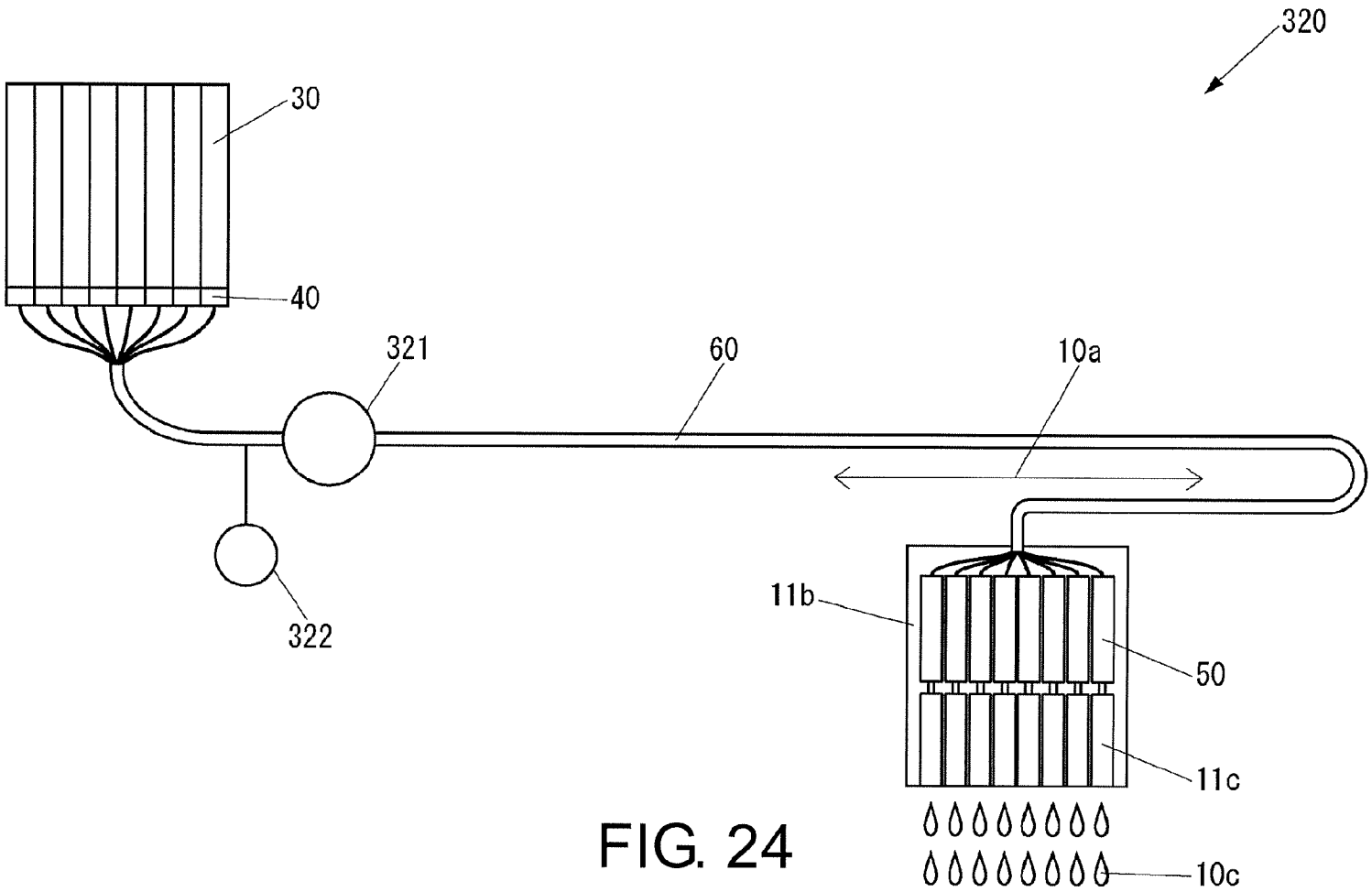
FIG. 24 is a schematic view of an ink supply device for an inkjet printer according to a fourth embodiment of the present invention.

FIG. 24 is a schematic view of an ink supply device 320 for the inkjet printer according to the present embodiment.

The configuration of the inkjet printer according to the present embodiment is similar to a configuration in which the inkjet printer 10 includes the ink supply devices 320 shown in FIG. 24 instead of the ink supply devices 20 (see FIG. 2).

As shown in FIG. 24, a configuration of the ink supply device 320 is similar to a configuration in which the ink supply device 20 includes a pump 321 that controls pressure of ink 10*c* so that the pressure of the ink 10*c* inside the replaceable ink container 30 becomes higher than that on the outside relative to an insertion opening 30*a* (see FIG. 3) of the replaceable ink container 30, and a pressure gauge 322 that detects the pressure of the ink 10*c* which is depressurized by the pump 321.

Next, functions of the opening plug 31 (see FIG. 3) of the replaceable ink container 30 will be described.

When a reed valve 32 (see FIG. 3) of the replaceable ink container 30 is closed, it is tightly closed by a pair of valve bodies 32*a*, 32*b* receiving force in a direction along which they make tight contact with each other by the pressure of the ink 10*c*. Accordingly, if the reed valve 32 is closed, the replaceable ink container 30 can prevent the stored ink 10*c* from leaking out to the outside through the insertion opening 30*a* by the reed valve 32.

When the replaceable ink container 30 is attached to the base 40 (see FIG. 5), the male connector 41 (see FIG. 5) of the base 40 is inserted into the insertion opening 30*a*. Then, the male connector 41 that has been inserted into the insertion opening 30*a* makes contact with the pair of valve bodies 32*a*, 32*b* of the reed valve 32, and pushes the valve body 32*a* and the valve body 32*b* apart. Here, if the reed valve 32 has been closed, the reed valve 32 opens by the valve body 32*a* and the valve body 32*b* being pushed apart by the male connector 41. That is, the replaceable ink container 30 has the reed valve 32 opened. Accordingly, the ink 10*c* in the replaceable ink container 30 becomes capable of being taken out to the outside via the opening plug 31 and the male connector 41. Here, the ink 10*c* in the replaceable ink container 30 can easily be taken out to the outside by suction by the pump 321.

In a case where the reed valve 32 is open, when the replaceable ink container 30 is detached from the base 40, the male connector 41 of the base 40 is pulled down relative to the opening plug 31. Further, when the male connector 41 is pulled down relative to the opening plug 31, the reed valve 32 closes by the male connector 41 being pulled out from between the valve body 32*a* and the valve body 32*b*. That is, the reed valve 32 is automatically closed tightly by receiving force in the direction along which the pair of valve bodies 32*a*, 32*b* makes tight contact with each other by the pressure of the ink 10*c*. When the male connector 41 is further pulled down relative to the opening plug 31, it is pulled out from the insertion opening 30*a*.

As described above, the ink supply device 320 can reduce the possibility that the ink 10*c* may leak from the replaceable ink containers 30 compared to in the conventional configuration, since the reed valves 32 receiving the pressure of the ink 10*c* automatically close when the male connectors 41 of the bases 40 are pulled out from the replaceable ink containers 30.

The ink supply device 320 includes the pump 321 that controls the pressure of the ink 10*c* so that the pressure of the ink 10*c* becomes higher on the inside than on the outside of the replaceable ink containers 30 with respect to the insertion openings 30*a* of the replaceable ink containers 30. Accordingly, since the ink supply device 320 can maintain the pressure of the ink 10*c* so that the pressure of the ink 10*c* is higher on the inside than on the outside of the replaceable ink containers 30 with respect to the insertion openings 30*a*, the ink 10*c* inside the replaceable ink containers 30 can be taken out almost to the last drip via the male connectors 41, even if the positions of the opening plugs 31 are provided at positions other than below the ink bags 34.

It should be noted that the ink supply device 320 controls the pressure of the ink 10*c* to be higher on the inside than on the outside of the replaceable ink containers 30 with respect to the insertion openings 30*a* of the replaceable ink containers 30, by sucking the ink 10*c* outside the replaceable ink containers 30 by the pump 321 to maintain the pressure of the ink 10*c* on the outside of the replaceable ink containers 30 to be of the negative pressure. However, the ink supply device 320 may control the pressure of the ink 10*c* to be higher on the inside than on the outside of the replaceable ink containers 30 with respect to the insertion openings 30*a* of the replaceable ink containers 30, by pressurizing the ink 10*c* inside the replaceable ink containers 30 by a pump to maintain the pressure of the ink 10*c* on the inside of the replaceable ink containers 30 to be of the positive pressure.

Further, the ink supply device 320 uses stretchable ink bags storing the ink 10*c* in the replaceable ink containers 30, however, the containers storing the ink 10*c* in the replaceable ink containers 30 may be containers that cannot stretch.

In the inkjet printers in the respective embodiments as described above, the replaceable ink containers and the bases are fixed relative to the main body and do not move in the main scanning direction, however, they may be mounted on the carriage and be movable together with the carriage in the main scanning direction.

The inkjet printers in the respective embodiments as described above are printers with a scheme in which, as shown in FIG. 1, printing in the main scanning direction by the recording heads 11*c* is carried out by moving the recording heads 11*c* in the main scanning direction by the carriage 11*b* relative to a recording medium 90 that does not move in the main scanning direction, and a position of the recording heads 11*c* relative to the recording medium 90 in the sub scanning direction is changed by transferring the recording medium 90 in the sub scanning direction relative to the recording heads 11*c* that do not move in the sub scanning direction, each time the printing in the main scanning direction is finished. However, the inkjet printers may be printers with schemes other than the scheme in the respective embodiments as described above. For example, the inkjet printers may be inkjet printers with a scheme in which printing in the main scanning direction by the recording heads 11*c* is carried out by moving the recording heads 11*c* in the main scanning direction by the carriage 11*b* relative to the recording medium 90 that does not move by being mounted on a table, and a position of the recording heads 11*c* relative to the recording medium 90 in the sub scanning direction is changed by moving the main body 11 in the sub scanning direction relative to the table on which the recording medium 90 is mounted, each time the printing in the main scanning direction is finished.

Furthermore, as ink discharging schemes in the inkjet printers according to the respective embodiments as described above, arbitrary schemes may be employed. For example, they may be of a valve jet scheme that depicts images by controlling ink discharges by opening and closing of a valve.

It should be noted that the opening plugs of the present invention may be used for purposes other than taking out the ink for the inkjet printers. That is, the opening plugs of the present invention can be adapted for use in arbitrary purposes in which takeout of liquid is performed through the opening plugs.

The invention claimed is:

1. An ink supply device for supplying an ink to a recording head for discharging the ink in an inkjet printer, the ink supply device comprising:

a replaceable ink container being a container for storing the ink and being replaceable; and a male connector to be inserted into the replaceable ink container to take out the ink from the replaceable ink container, wherein the replaceable ink container has an insertion opening where the male connector is to be inserted formed therein, the replaceable ink container includes an opening plug that plugs the insertion opening, and the opening plug includes a reed valve that is pressed by the male connector and opened when the male connector is inserted into the insertion opening, and that is closed by making contact with the male connector when the male connector is pulled out from the insertion opening, the reed valve includes a valve body which is in film shape, the valve body extends toward a direction which the male connector is inserted into the insertion opening, and an end portion of the valve body is fixed at a position inside the replaceable ink container and near the insertion opening.

2. The ink supply device according to claim 1, wherein the reed valve is a valve that is closed by receiving pressure of the ink when the male connector is pulled out from the insertion opening.

3. The ink supply device according to claim 1, wherein the reed valve is a valve to which closing force is applied by rigidity of a valve body itself when the male connector is pulled out from the insertion opening.

4. The ink supply device according to claim 1, wherein the opening plug further includes: a valve biasing unit that biases the reed valve in a direction along which the reed valve closes.

5. The ink supply device according to claim 1, wherein the replaceable ink container includes:

an ink bag of which capacity is capable of being changed according to an amount of the stored ink, and a bag biasing unit that biases the ink bag in a direction along which the capacity of the ink bag is decreased.

6. The ink supply device according to claim 1, further comprising:

a pump that controls pressure of the ink, so that the pressure of the ink becomes higher on an inside than on an outside of the replaceable ink container with respect to the insertion opening.

7. The ink supply device according to claim 1, wherein a shape of the male connector in the cross section vertically intersecting a direction of insertion into the insertion opening is an elongated shape.

8. The ink supply device according to claim 1, wherein the male connector and the reed valve are fitted with each other to a degree by which the ink does not leak out from between the male connector and the reed valve, when the male connector has been inserted into the insertion opening.

9. The ink supply device according to claim 1, wherein the opening plug includes an O-ring for preventing the ink from passing through, and the O-ring is arranged at a position that prevents the ink from passing through between the male connector and the O-ring, when the male connector that has been inserted into the insertion opening is keeping the reed valve opened.

* * * * *